US005299520A

United States Patent [19]

Wilts

[11] Patent Number: 5,299,520

[45] Date of Patent: Apr. 5, 1994

[54] SHIP, IN PARTICULAR MERCHANT SHIP

[75] Inventor: Johann Wilts, Emden, Fed. Rep. of Germany

[73] Assignee: Thyssen Nordseewerke GmbH, Emden, Fed. Rep. of Germany

[21] Appl. No.: 982,283

[22] Filed: Nov. 25, 1992

[30] Foreign Application Priority Data

Nov. 30, 1991 [DE] Fed. Rep. of Germany ..... 4139542

[51] Int. Cl.[5] ..... B63B 1/00

[52] U.S. Cl. ..... 114/56; 114/77 R

[58] Field of Search ..... 114/56, 65 R, 72, 73, 114/77 R

[56] References Cited

U.S. PATENT DOCUMENTS 4,630,561 12/1986 Franz et al. ..... 114/65 R

FOREIGN PATENT DOCUMENTS 71292 4/1986 Japan ..... 114/65 R

*Primary Examiner*—Jesus D. Sotelo

*Attorney, Agent, or Firm*—Nils H. Ljungman & Associates

[57] ABSTRACT

Ship, in particular merchant ship, with at least one large power plant such as a main propulsion engine (11) located in the ship's steel hull, around which there are the necessary auxiliary spaces, such as access spaces, bunkers, tanks, compartments, control rooms, workshops, control devices, distribution centers, pumps, hydraulic power plants, etc., characterized by the fact that the ship's hull (12), in the vicinity of the main power plant (11), has a nacelle (20) which is open on top, which is designed so that it becomes wider in steps from bottom to top and/or in the longitudinal direction of the ship (13), and is preferably free of bulkheads and platforms, that the height, length and width of the stepped walls (14, 15, 16) next to or under the main power plant (11) are of a specified modular dimension on the order of several meters, in particular 3 m, in at least one dimension, in particular the height, but preferably in two dimensions, and particularly preferably in all three dimensions, and at least a significant portion of the auxiliary spaces are located in rectangular containers or container frames (17, 21, 25) located next to, forward and/or aft of the main power plant (11) or on the stepped walls (14, 15, 16).

12 Claims, 17 Drawing Sheets

SHIP, IN PARTICULAR MERCHANT SHIP

BACKGROUND OF THE INVENTION

1. Field of the Invention

This invention generally relates to a ship, preferably a merchant ship. The ship has at least one large power plant, such as a main propulsion engine located in the steel hull of the ship. Around the engine are auxiliary spaces, such as access spaces, bunkers, tanks, compartments, control rooms, workshops, control devices, distribution centers, pumps, hydraulic power plants, etc.

2. Background Information

In building a merchant ship, the number of hours spent, on the one hand, in the construction of the steel hull and, on the other hand, in outfitting, tend to be split in a ratio of approximately 1:1. The preliminary shipbuilding work generally takes approximately 14 weeks, the assembly on the slip takes approximately 20 weeks, and the outfitting approximately 20 weeks.

The documents relating to outfitting ar generally delivered to the outfitting department relatively late, after the ship has been designed, the design of the ship necessarily coming first. The differences in tolerance between the ship's hull, which has already been completed, and the equipment installed in the outfitting stage, tend to require expensive fitting work. The outfitting is also dependent to a large extent on the weather, because a great deal of the work has to be done on the slip.

OBJECT OF THE INVENTION

The object of the invention is to significantly improve the profitability of merchant shipbuilding, and in particular to eliminate the dependence on the weather of the work which must currently generally be done on the slip. Overall, it becomes possible to significantly reduce the length of time required to build a ship, particularly a merchant ship.

SUMMARY OF THE INVENTION

The reduction in time is achieved according to the invention on a vessel of the type described further above, in accordance with features disclosed hereinbelow.

The invention is generally based on the knowledge that, usually, on very different types of ships, particularly merchant ships, the widths of the main power plants differ only insignificantly from one another, and the machine room forward bulkhead is generally at a distance on the order of about 3 m from the main power plant. The result is a possible standardization by means of standard and adjustable containers or container frames. Because the compartment known as the nacelle essentially has only vertical and horizontal walls, and expands toward the top, and does not preferably include any bulkheads or ribs and platforms, containers preassembled and pre-equipped outside the ship's hull simultaneously with the construction of the hull can be easily introduced into the steel hull from above, following the completion of the ship's steel hull. Because there are only vertical and horizontal walls, the interfaces between the standardized, stackable containers and the ship's hull can be designed in a simple manner.

According to the invention, therefore, the interior of the ship's hull, in the vicinity of the main power plant, in particular of the main engine, is divided into two areas, namely into a nacelle which has essentially only horizontal and vertical walls, and a transitional space designed in a conventional manner to make the transition to the ship's skin which, as disclosed hereinbelow, can appropriately contain usable spaces such as bunkers, tanks, compartments and workshops. These spaces can all be easily manufactured, together with their fittings, on the slip, because the equipment associated therewith can usually be installed quickly and easily, in contrast to the equipment required for the engine control and operation, which tends to take approximately as much time to manufacture as it takes to build the ship's hull.

According to the invention, therefore, there are preferably only flat walls at right angles to one another in the machine room, or engine room, and essentially all bulkheads, frames or ribs, and platforms are eliminated. As a result of the shape of the machine room according to the invention, the outfitted containers or container frames can essentially be loaded, installed and connected in a single day, before the launching. The superstructures can then be installed on the following day.

To the extent that the main power plant is the main engine, the nacelle preferably tapers in steps toward the stern.

Since as many standardized containers or container frames as possible are preferably to be installed in the area of the ship's hull around the main power plant, the space between the nacelle and the outer skin of the ship is preferably designed as disclosed in accordance with yet another refinement disclosed hereinbelow. Particularly, this space is so small that essentially no standardized containers can be introduced in it. In this manner, essentially the only function of this intermediate space is to make the transition from the external skin, which generally has curved lines, to the walls of the nacelle which are preferably only vertical and horizontal.

To take into consideration the individual dimensions of a given main power plant, all that is generally necessary is to have additional adjustable containers fore and/or aft of the main power plant. The other containers can have standard modular dimensions in all three dimensions.

In each case, all containers preferably have a height, e.g. about 3 m, which corresponds to the modular dimension.

Standard containers for being inserted into the ship are preferably appropriately configured as disclosed hereinbelow.

Since, as disclosed hereinbelow, there are preferably standard apertures in the walls, or bulkheads, of the nacelle, lines can be laid and/or connections can be easily made between the containers and the space between the stepped walls and the external skin of the ship.

In a particularly advantageous manner, as disclosed hereinbelow, the containers are preferably divided into two different areas in the vertical direction. The upper portion then preferably generally has a height of approximately 2 m, so that it can be essentially man-sized, or accessible to persons. Lines or other components can then be located in the lower part, which can be about 80 cm high, for example.

All the advantageous structural refinements of the containers according to the invention are disclosed hereinbelow. As is also disclosed hereinbelow, the containers are preferably connected vertically to one another and to the substrate.

From container frames open on the side and/or on the top and/or on the bottom, which can be used in this form in many cases, since the interiors of adjacent container frames are thereby connected to one another, containers closed on all sides can be created by the installation of panels.

The modular dimension of about 3 m has the advantage that the containers can essentially be divided vertically into a man-sized space and a space for the installation of lines and utilities. The preferable width of about 3 m also makes it possible for the containers to be transported by trucks or railroad cars. However, it should be understood that, within the scope of the present invention, it is possible to allow for a different modular dimension, such as a modular dimension of about 2 m, about 4 m, about 5 m, and about 6 m, among others.

As a result of the modular dimension according to the present invention, which dimension may be about 3 m, the length of the engine room appropriately essentially consists of the length of the main engine, the length of the shaft, an approximate 3 m area forward of the main engine, plus conventional tolerances. The width of the engine room in the upper portion thereof is essentially defined by the width of the main engine, plus two additional lateral modular dimensions on both sides, and the necessary lateral clearance. In the lower portion of the engine room, on both sides of the main engine, only one modular dimension, plus tolerances, is essentially left free, where containers or container frames can be installed.

Fore and aft of the main engine, adjustable containers are preferably installed in the transverse direction. These adjustable containers compensate for the different widths of main engines.

The connection of the individual containers or container frames located above one another is preferably accomplished by plug-in connections, whereby brackets are preferably used as transverse connectors, and are preferably bolted by means of Peco bolts or other suitable attachment means. The container frames are preferably divided using standardized struts.

The struts are preferably suspended and bolted by means of Peco bolts. In a similar manner, the pipe hangers, floor plates, cable harnesses, stairs, save-alls or catch basins are preferably fastened so that manual welding processes can be reduced to a minimum.

Foundations for equipment and engines are also preferably suspended and bolted in the container frames.

This design, according to the present invention, includes only right angles, and the interfaces between the containers can essentially be predetermined to an accuracy measured in millimeters. Thus, using this method, the interfaces between the prefabricated steel hull and the fittings can be determined very precisely.

There are preferably horizontal and vertical transport routes in the containers. These transport routes can, essentially, easily be planned with a height of 2 m and a free width of 1 m. Preferably, the transport routes end in the vicinity of the engine room crane. The horizontal transport routes are preferably equipped with standard I-beams and bottom flange crane trolleys.

The standard apertures preferably consist of conventional manholes. These manholes are preferably installed in the individual tanks according to a fixed standard. Each tank preferably has its standard aperture between the first two ribs, namely in a location which is as far astern as possible and toward the middle of the ship's hull. Preferably, there is a manhole in the horizontal stepped wall and a manhole for side tanks at the lowest position of the vertical stepped walls.

The manhole covers are preferably designed as connecting plates. All the apertures required for the tank can be installed in these connecting plates.

The apertures are preferably located in the position most favorable for the operation of the ship. The lowest point of the tank is reached when the ship is sternheavy. The apertures are highly desirable locations for sounding pipes and suction tubes. Tank heaters, which always heat the suction line, also, can be advantageously connected.

As a result of the standard position and construction described immediately above, all the torch cutting work for apertures can be identified as early as during the design phase. Hydrostatic tests of the tanks can be conducted with blind hatches while the ship is being prefabricated, and the preservation for the tank can also be completed early, even before the installation of the containers.

The power supply for the superstructures installed after the introduction of the main engine and the containers is preferably accomplished by means of a service shaft located amidships, on the forward side of the engine room. According to the invention, all the power supply lines in the superstructures are preferably laid in such a shaft. Power for the individual decks is preferably supplied from this shaft. The shaft can be entered for inspection and maintenance. As a result of the service shaft, the interfaces between the engine room and the superstructures can be clearly and precisely specified. All the cables and pipelines can preferably be laid in this shaft. As a result of this arrangement, the vertical tubular tracks and cable ducts in the engine room can be suspended in the container frame as a finished unit which essentially fits precisely.

As a result of the containerization of merchant shipbuilding in the area of the main engine made possible by the invention, the following advantages are achieved:

The fittings can be constructed following the design phase, simultaneously with the construction of the ship's hull.

Thanks to the use of standard apertures, the drawings for the apertures can be defined immediately. There is no need to wait for the approved pipeline diagrams.

The location of all the interfering corners and edges is known in advance.

Plans for transport routes, stairs and ventilation systems can be defined before the engine layout.

Functional groups can be combined. There can be an efficient arrangement based on function, serviceability and frequency of maintenance, thereby achieving decisive advantages.

Functional units can also be placed in the deck area. For example, hydraulic units for deck machinery can be installed complete with reservoir tank and controls in one container, and installed by means of a mounting plate.

By creating a large nacelle which widens toward the top, and as a result of the absence of bulkheads and platform decks, not only is the installation of the containers and the main engine made easier, but there is also more usable space available.

Repetitive work can be reduced to a minimum by the use of Computer-Assisted Design (CAD) and a library of drawings.

The containerized shipbuilding method can be applied anywhere, regardless of the type of vessel.

Standard containers can also be placed on deck for pipe bridges on gas tankers and special ships.

According to the invention, control rooms and distribution centers can be created by closing the fields, or flats, of the container frames with panels from standard and adjustable containers according to the invention.

As a result of the breakdown of the engine room into a number of containers, the calculations before the start of ship-building are significantly simplified.

The combination into functional units makes it easier to determine a more precise planning and scheduling process.

The employment of the personnel working on the outfitting of the ship is also made more uniform as a result of the high proportion of prefabrication. The extreme fluctuations of the current system of building the ship entirely on the slip are largely eliminated.

Peak work loads can also be subcontracted, because the containers can be transported, and because the external dimensions of the standard and adjustable containers can be clearly defined in advance.

Functional units, e.g. recooler groups, separators, boilers, etc. can also be subcontracted for delivery of standard containers.

The fabrication of the standard containers according to the invention is carried out on a gauge, e.g. on a fabrication island. Standardized holders, substructures and foundations for the containers can be prepared in a similar manner.

Since all the parts are repetition parts, extremely close fabrication tolerances can be achieved with the use of gauges. There is no need for expensive fitting work.

All parts which are prefabricated steel structures, are sandblasted, primed and hot-dip galvanized according to the invention.

The use of closed hollow structural shapes for the manufacture of the containers according to the invention results in high strength with a small, smooth surface. In this manner, the preservation can be applied rapidly and economically.

The standard containers are outfitted in a heated building. All the workshops are connected to this building. There is also an intermediate warehouse for standard parts, which makes it possible to keep transport to a minimum. Preferably there should be only one manufacturing level, so that vertical transports are not necessary.

According to the invention, the standard containers can also be equipped with stairs, floor plates, save-alls and transport routes to eliminate all the staging, or racks, in the engine rooms. Before the engine room is loaded with the fully-equipped containers, and before the installation of the superstructures, the machine shaft is given its final preservation. The stepped shape of the nacelle for the main engine means that the preservation can be applied without the use of staging.

As a result of the combination of the equipment into functional units, the equipment can be fully wired in the containers. By defining cableways, it is possible to determine cable lengths precisely, and the amount of waste produced is significantly reduced.

All containers are given their final coat of paint before they are installed on board.

In addition, according to the invention, several containers which will be installed on top of one another can be preassembled as a single component, hoisted on board and installed as a unit. The assembly times for the equipment cranes are drastically reduced by the containerization and prefabrication.

As a result of the extensive use of Peco bolts for assembly and installation, expensive manual welding and the reapplication of preservation coatings can be almost completely eliminated.

And because the fittings are manufactured in plants away from the slip, the danger of accidents is also significantly reduced.

As a result of the standardization, the warehousing of semifinished products can also be simplified. If semifinished products which are on double the modular scale, e.g. 6 m, are used, little waste is generated.

An automatic cutting line can be set up to trim the semifinished products to the precise length.

The expensive process of boring fastening holes in semifinished products can be replaced by a more economical punching or stamping.

To transport the containers, there is a transport car, which has mountings for the pipes of the standard and adjustable containers, and on which it is possible to transport, for example, three standard containers or adjustable containers stacked on top of one another, with a total height of 9 m.

For installation on board, a transport apparatus, similar to a container spreader, can be manufactured. The slope of the slipway can be adjusted to handle this apparatus when it is loaded.

The foundations for the container consist of a welded structure. The top plate has a hole, into which a guide mandrel is hammered, to fix the container in position. The foundations can be installed on the cellular double bottom of the hull to within millimeters of the specified position as early as during the prefabrication stage. It is also easily possible to install the foundations on the slipway, after the hull has been completed, with the use of appropriate equipment.

The standardized divisions for a standard container are also manufactured from rigid hollow structural shapes. The suspension system for the dividers consists of a bracket, which is pre- drilled and is fastened to the structural shape by means of fillet welds.

During assembly, the divider is suspended in the appropriate position, Peco bolts are guided and shot through the holes, and then the dividers are fastened with nuts.

According to the invention, the adjustable containers consist of the same individual parts as the standard containers. The adaptation to the required dimension is made solely by changing the length of the center piece.

According to the invention, the vertical pipes in the shape of rectangular pipes are closed by end plates, in which there are alignment holes for the alignment pins which guarantee the correct vertical orientation.

If containers are stacked, the alignment pins are hammered into the alignment holes of the rectangular tube therebelow. The rectangular tube located thereabove is then placed on the alignment pin in question and guided thereby. Deformations of the container frames can be compensated for by pulling them apart by means of appropriate devices.

In the container, the substructures for equipment and assemblies can be installed on the horizontal divider. These substructures are standardized and prefabricated. With the proper determination of the dimensions and semifinished products, a small number of prefabricated substructures can be manufactured and used to meet almost all requirements. Special structures can be manufactured to meet the requirements of particular applications.

The standardized dividers of the standard container are manufactured from rigid hollow structural shapes. The divider mounting consists of a bracket, which is pre-drilled and fastened to the structural shape by means of fillet welds.

BRIEF DESCRIPTION OF THE DRAWINGS

The invention is explained in greater detail below with reference to the accompanying drawings, which show.

DESCRIPTION OF THE PREFERRED EMBODIMENTS

Figure 1:
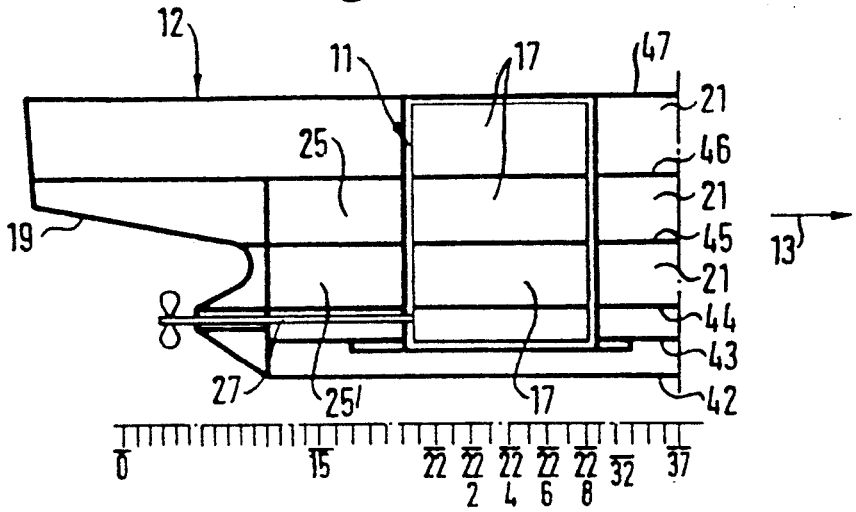
FIG. 1: A schematic side view, in partial cross section, of the aft portion of the ship's hull of a ship according to the invention.
Figure 2:
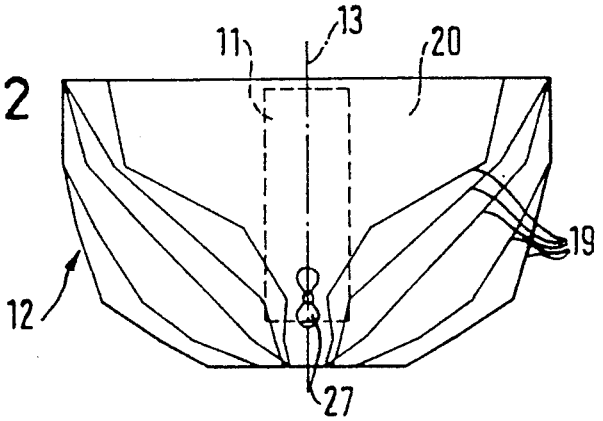
FIG. 2: A schematic body plan of the ship's hull illustrated in FIG. 1.
Figure 8:
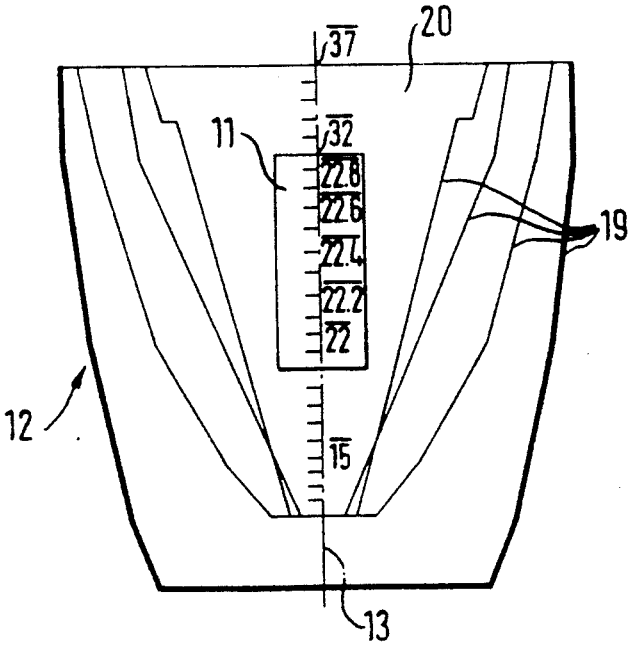
FIG. 8: A schematic plan view, in partial cross section, of the ship's hull illustrated in FIGS. 1 and 2, whereby four lines, or outlines, or runs, of the vessel are shown.

As illustrated in FIGS. 1, 2 and 8, a main engine 11 can be located amidships in the aft portion of a steel hulled ship with hull 12, and aft of the engine is a shaft 27. Individual ribs 0 to 37 are indicated, seen in the longitudinal direction of the ship. FIG. 1 also shows the base 42, the cellular double bottom 43, the floor 44, a lower platform deck 45 located above floor 44, an upper platform deck 46 located above deck 45, and the main deck 47. The ribs 0 to 37, as illustrated, are essentially shown in order to assist in the understanding of the present invention.

It will be noted in FIG. 2 that, essentially, the lines indicated at 19 reflect various cross-sectional outlines of the ship at different stages along the longitudinal extent of the ship. It will be further noted that the different outlines 19 correspond to different vertical cross-sectional views of the ship shown in other Figures. Likewise, in FIG. 8, the lines indicated at 19 reflect various cross-sectional outlines of the ship at different stages throughout the vertical extent of the ship. Here also, it will be further noted that the different outlines 19 correspond to different horizontal cross-sectional views of the ship shown in other Figures.

Figure 9:
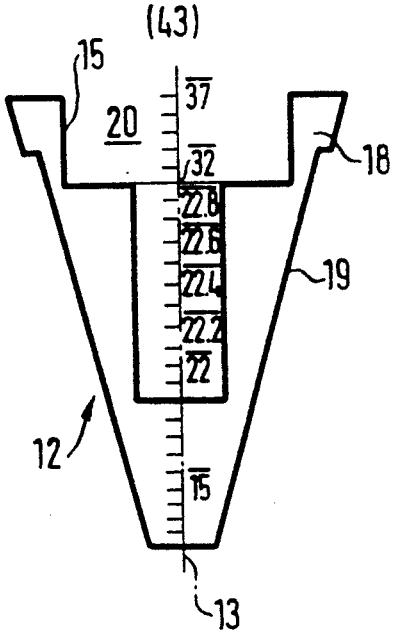
FIGS. 9 to 11: Horizontal sections of the ship's hull illustrated in FIGS. 1, 2 and 8, at the level of the cellular double bottom, the lower platform and the upper platform.
Figure 10:
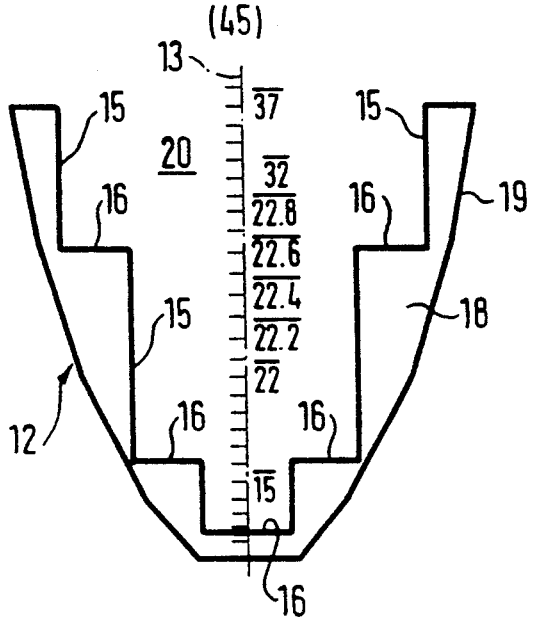
Figure 11:
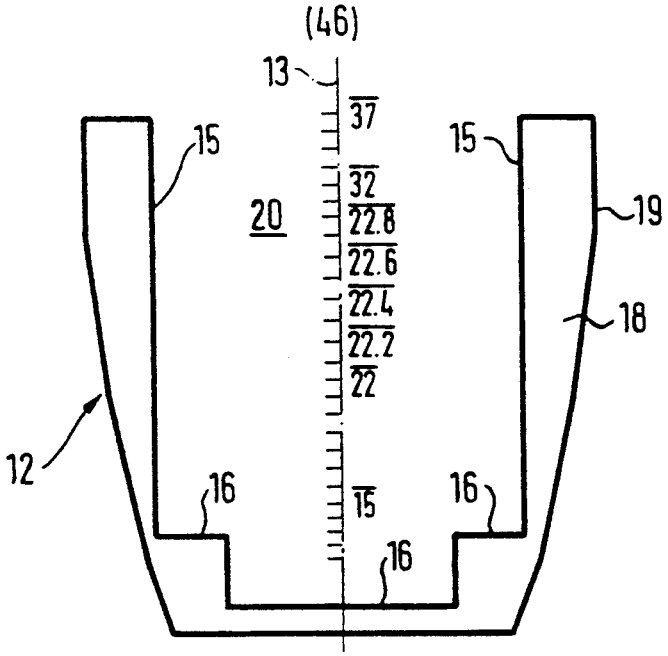
Figure 12:
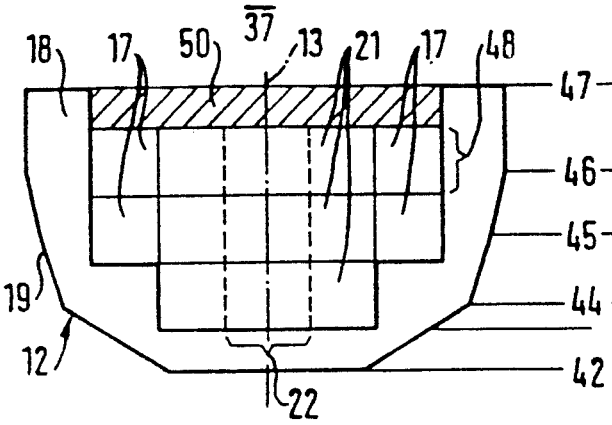
FIGS. 12 to 16: Body sections as illustrated in FIGS. 3 to 7, whereby in addition, the main engine and the container surrounding the engine are shown.
Figure 13:
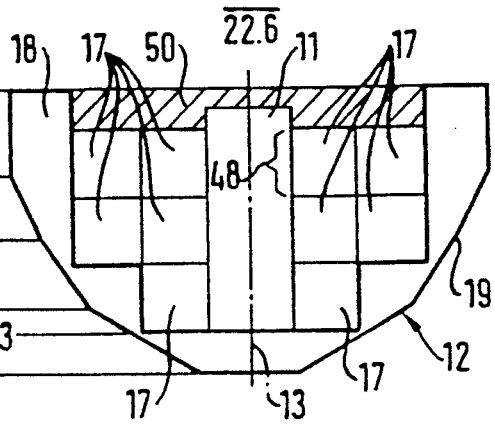
Figure 14:
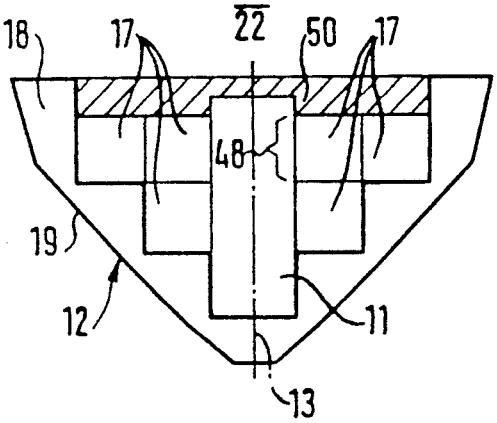
Figure 15:
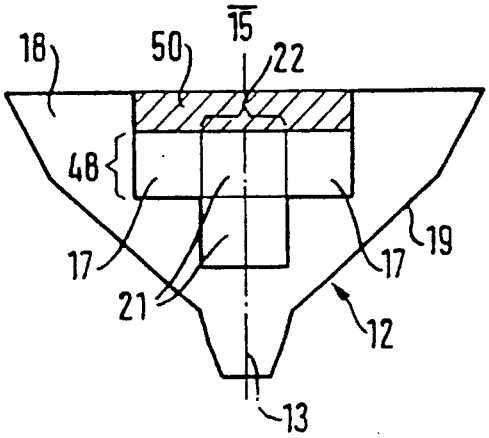
Figure 16:
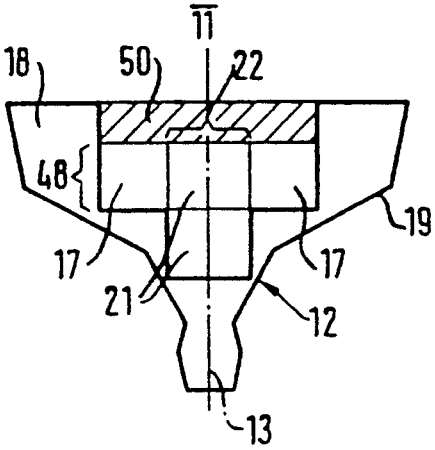

FIGS. 3, 4, 5, 6 and 7 show the body cross sections, respectively, at the location of ribs 37, 22.6, 22, 15 and 11. In the vicinity of these ribs, the aft portion of the ship's hull 12 preferably has a nacelle 20 representing the engine room, which is preferably free of ribs, bulkheads and platforms, and preferably becomes wider from bottom to top in a stepped manner. Alternatively, or additionally, as illustrated in FIGS. 9 to 11, nacelle 20 is preferably tapered so that it narrows from fore to aft along the longitudinal extent of the ship. FIGS. 9 to 11 show horizontal cross sections of the aft portion of the ship's hull 12 at the level of the cellular double bottom 43, of the lower platform deck 45, and of the upper platform deck 46. These figures also show the ribs using the same reference numbers as in FIGS. 1 and 8.

In accordance with the configuration illustrated in FIGS. 3 to 7 and 9 to 11, the nacelle 20 for the main engine 11 is preferably defined exclusively by horizontal stepped walls 14, vertical longitudinal stepped walls 15, and vertical cross stepped walls 16.

The disclosure now turns to the Figures showing horizontal cross-sections of the ship.

It should be noted that, in these, as well as all of the Figures, the longitudinal direction of the ship is designated 13.

FIGS. 1 and 12 to 19, as well as corresponding FIGS. 3 to 7 and 9 to 11, also show containers 17, 21 and 25 inside the nacelle 20, whereby the sizes of the stepped walls 14, 15 and 16 and of the containers 17, 21 and 25 are preferably determined in the following manner, according to the invention.

Figure 18:
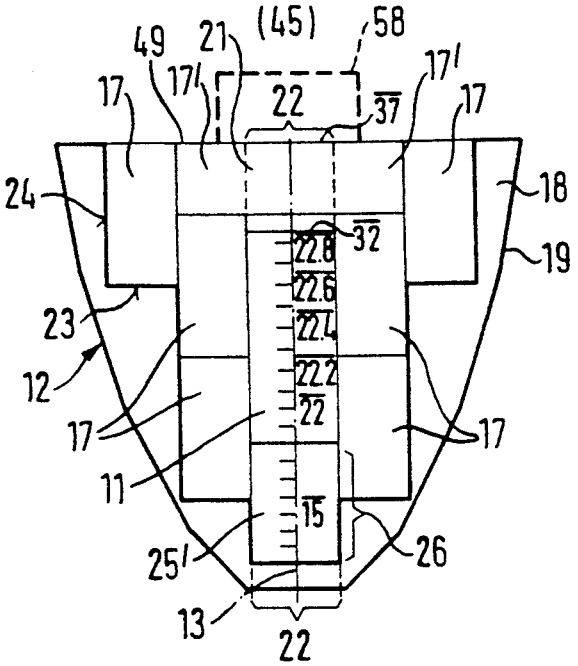
Figure 19:
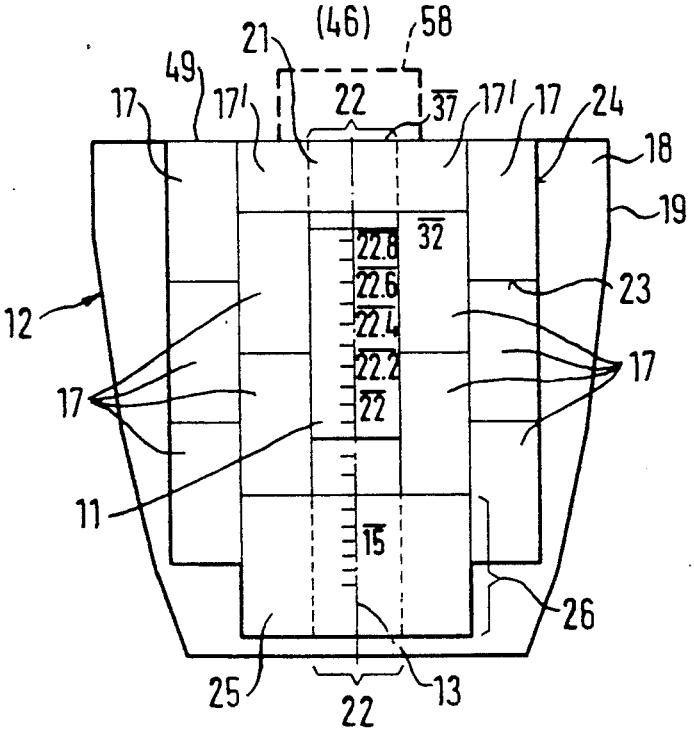

The illustrated standard containers 17, as shown in FIGS. 18 and 19, preferably have a rectangular horizontal cross section with a short side 23 and a long side 24. The length of the short side 23 is preferably about 3 m, and the length of the long side is 6 m. However, it is possible to adopt other dimensions within the scope of the present invention. Particularly, the length of the short side may alternatively be about 2 m, about 4 m, about 5 m, or about 6 m, among other possible lengths. Likewise, the length of the long side may alternatively be about 4 m, about 8 m, about 10 m, or about 12 m, among other possible lengths. It should be appreciated that this applies to other dimensions disclosed hereinbelow, such that, within the scope of the present invention, it is possible to adopt dimensions which are between about two-thirds as great and about twice as great as those disclosed hereinbelow. However, it should also be understood that the dimensions disclosed hereinbelow are the preferred dimensions in accordance with the preferred embodiments of the present invention.

The vertical dimension 48 of the standard container 17, as illustrated in FIGS. 12 to 16, is preferably about 3 m, i.e. it is the same as the modular dimension which determines the base surface. As shown in FIGS. 12 to 19, the stepped walls 14, 15, and 16 in the vicinity of the main engine 11 are preferably arranged so that one or two standard containers 17 can be located next to the main engine 11. The lengths, widths and heights of the stepped walls 14, 15 and 16 are also preferably fitted into the specified modular dimension. Taking manufacturing tolerances into consideration, the containers 17, 21 and 25 are preferably in contact with the stepped walls 14, 15 and 16, so that they can be fastened to the ship's hull 12 in a suitable manner.

Figure 17:
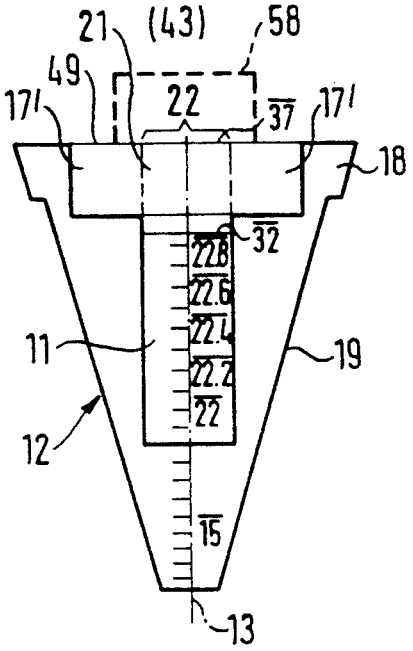
FIGS. 17 to 19: Horizontal sections, similar to FIGS. 9 to 11, where the main engine and the container are also shown.

As shown in FIGS. 1 and 17 to 19, three adjustable containers 21, stacked one on top of the other, are preferably located forward of the main engine 11, which have the modular dimension in the longitudinal direction of the ship 13 and in the vertical direction, i.e. they preferably have side lengths of about 3 m in these directions. As shown in FIGS. 17 to 19, however, in the transverse direction of the ship, the center adjustable area 22 corresponding to the width of the main propulsion engine 11 is preferably somewhat wider, to fill up the space between the main propulsion engine and the forward engine room bulkhead 49. On both sides, next to the center adjustable area 22, there are each two cubic areas 17', with dimensions of 3 m on a side.

The three adjustable containers 21 located one on top of the other are identical, and/or oriented with, or generally aligned with, one another in the vertical direction.

Astern of the main engine 11, as shown in FIG. 18, between the floor 44 and the bottom platform deck 45, there is preferably an additional adjustable container 25', the width of which is preferably about the same as the width of the main engine 11, whose length is approximately the same as at least a major portion of the length of the shaft 27 and whose height is preferably equal to approximately the preferred modular dimension of about 3 m.

Between the lower platform deck 45 and the upper platform deck 46, as shown in FIGS. 1 and 19, there is preferably yet an additional adjustable container 25, whose dimensions in the longitudinal direction of the ship 13 and in the vertical direction are preferably about the same as those of the adjustable container 25' illustrated in FIG. 18, but which, in the transverse direction of the ship, has a width which is greater by 3 m to both sides, so that as shown in FIG. 19, it fits substantially exactly into the modular dimension defined by the width of the main engine 11 and of the standard container 17.

On the adjustable containers 25, 25', therefore, essentially only the vertical dimension is preferably on the modular scale, while the transversely oriented adjustable area 22 is preferably adapted to the width of the main engine 11 and the longitudinally oriented adjustable area 26 is preferably adapted to the length of the shaft 27.

As shown in FIGS. 12 to 19, essentially the entire space next to, fore and aft of the main engine 11 can preferably be completely filled with standard containers 17 and adjustable containers 21, 25, 25'.

As shown in FIG. 1, the distance from the floor 44 to the lower platform deck, the distance from the lower platform deck 45 to the upper platform deck 46, and the distance from the upper platform deck 46 to the main deck 47 all preferably assume the modular dimension, i.e. they are all preferably about 3 m.

Figure 3:
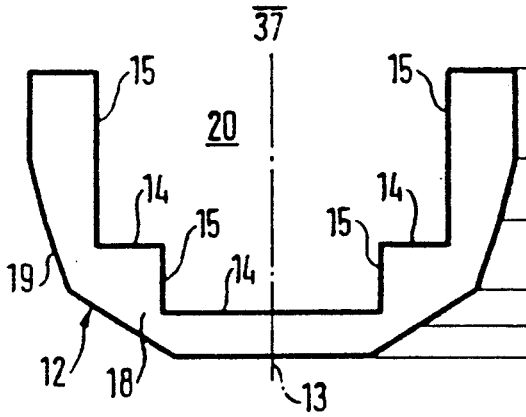
FIGS. 3 to 7: Vertical, or body, cross sections of the ship's hull according to invention, along the ribs illustrated in FIG. 2.
Figure 4:
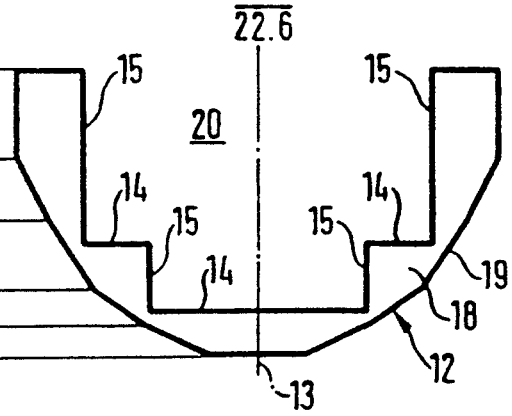
Figure 5:
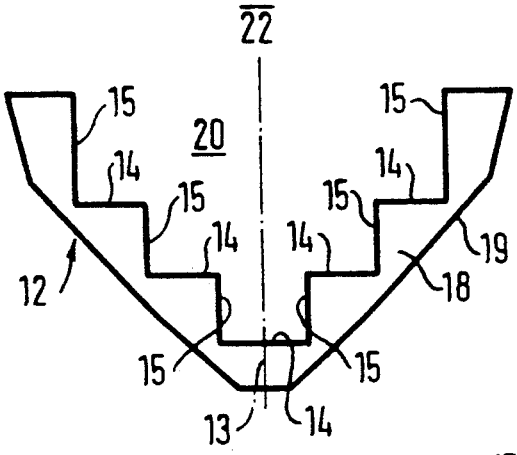
Figure 6:
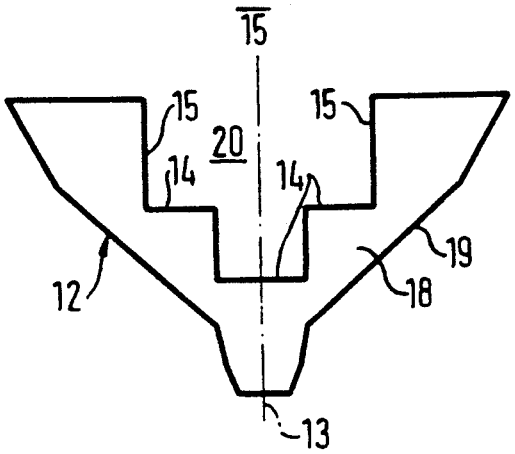
Figure 7:
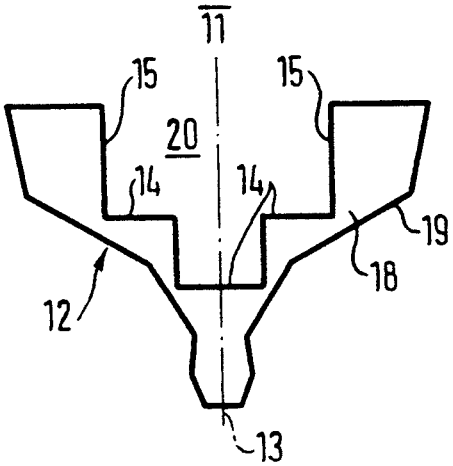
Figure 20:
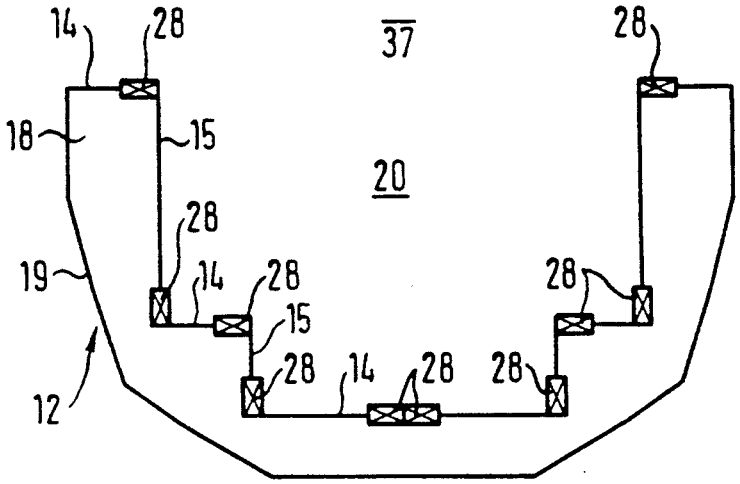
FIG. 20: A body section similar to FIG. 3, where the location of standard apertures is also shown.
Figure 21:
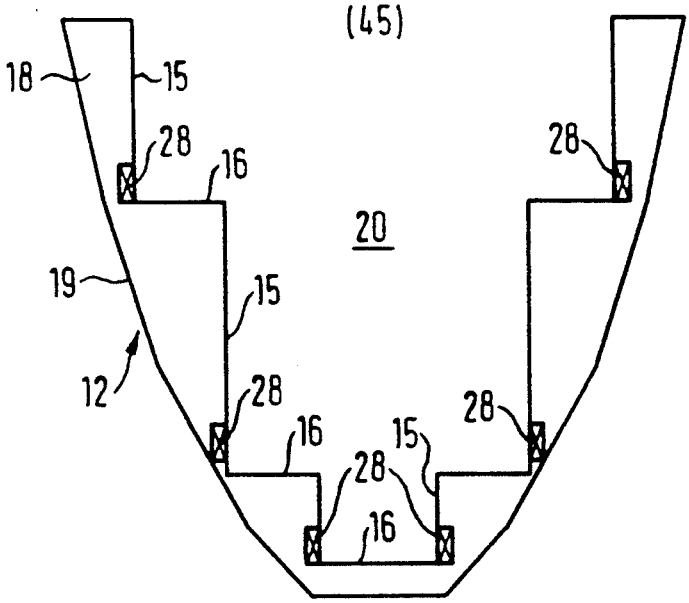
FIG. 21: A plan view of the run of the vessel, at the level of the lower platform as illustrated in FIG. 18, also showing the standard apertures.

FIGS. 20 and 21 show, by way of example, a body section at the rib 37 and the run of the ship at the level of the lower platform deck 45, as shown in FIGS. 3 and 10, also showing additional standardized apertures through the stepped walls 14, 15. The apertures 28 preferably have the size of a manhole, and there are preferably corresponding connections, sockets, openings, etc. in the containers 17, 21 and 25 to be installed, which communicate with the apertures 28.

The space between the walls of the nacelle 20 and the external skin 19 of the ship is preferably accessible through the apertures 28. As a result of the arrangement of tanks or compartments, for example, this area of the ship's hull 12 can be designed as usable cargo space 18, and the apertures 28 can be used as a means of communication between them and the containers 17, 21 25.

Aft of the nacelle 20, as shown in FIG. 9, and of the container 21 shown in FIG. 17, additional standard containers can be installed on both sides, in which case the aft outside vertical tubes may be omitted, to make the adjustment for the ship's contour, which tapers toward the stern. In other words, it is possible, in accordance with the present invention, to install additional standard containers in space 18, on both sides of the ship, in that portion of the ship depicted in FIGS. 9 and 17. It should be understood that the area of the ship just described will generally also lend itself to other possible arrangements for the installation of standard containers.

Space 18 also preferably includes therewithin a suitable arrangement for providing reinforcement and support for the stepped walls 14, 15. Such an arrangement may include bulkheads, gussets and other possible appropriate forms of vertical, horizontal or other reinforcement.

The construction of a ship like the one illustrated in FIGS. 1 to 21 preferably proceeds as follows.

While the ship's hull is manufactured in the form illustrated in FIGS. 1 to 11 in the slip of a shipyard, the components intended for installation in the nacelle 20, such as: the main engine 11, the shaft 27 and the containers 17, 21, 25, 25' and the equipment contained therein; can be manufactured at the same time in special workshops.

Following completion of the ship's hull, first the main engine 11 and then the shaft 27 are preferably installed. Then, the standard containers 17 and the adjustable containers 21, 25 and 25' are preferably loaded one after the other into the ship from above. If necessary, several containers, e.g. the adjustable containers 21 illustrated in FIG. 1, can preferably be combined into a single component, and then installed together in the ship.

After all the components inside the nacelle 20 have been arranged, the electrical, hydraulic and other connections between the individual components are preferably made, and the containers are preferably fastened in the appropriate manner.

Then the superstructures are preferably installed on top of the ship's hull, as shown only schematically in FIGS. 12 to 16 as a deck plate 50. By means of a supply shaft 58 (FIGS. 17–19), which is preferably large enough to permit access and maintenance and is preferably located forward of the machine room bulkhead 49, the necessary connections between the superstructures and the engine room can preferably be made.

Figure 24:
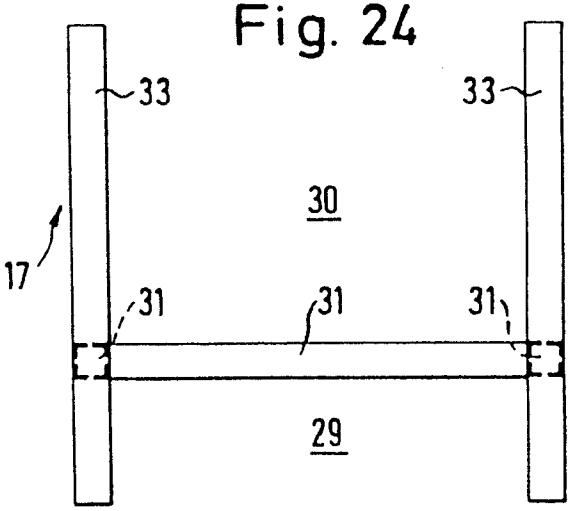
FIG. 24: An end view of the subject of FIG. 22.
Figure 22:
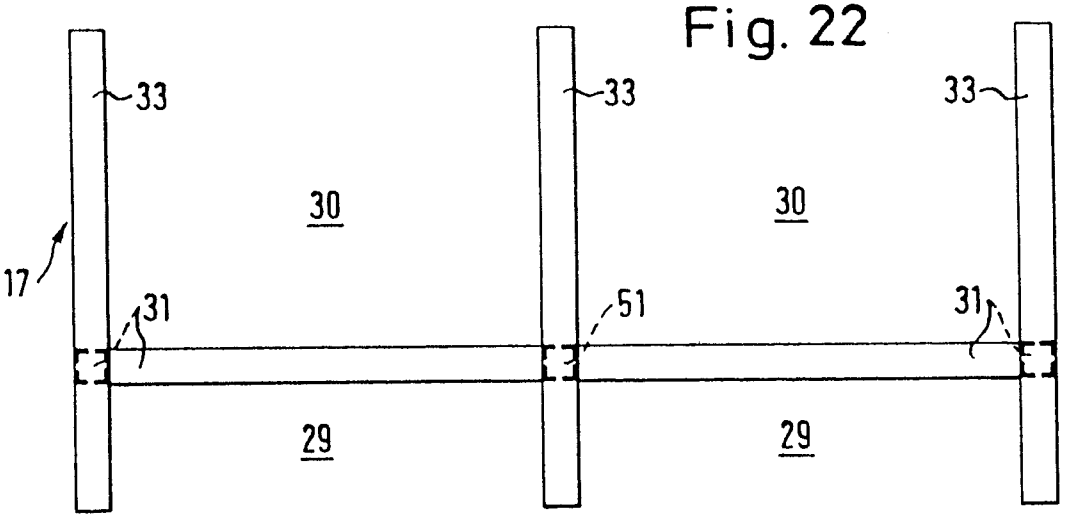
FIG. 22: A side view of a standard container frame according to the invention.
Figure 23:
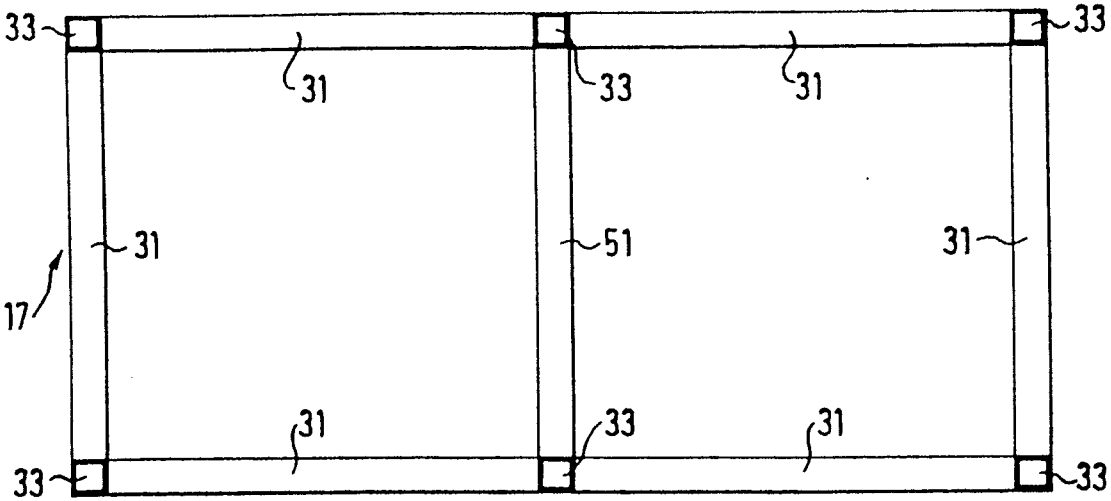
FIG. 23: A plan view of the subject of FIG. 22.

FIGS. 22 to 24 show a preferred configuration of a standard container frame 17 according to the invention. This frame preferably consists of vertical rectangular tubes 33, each preferably located at the modular dimension of about 3 m, and whose height is also preferably the same as the modular dimension, i.e. about 3 m, and which have a cross section of about $0.2\times0.2$ m. Preferably, at the level of approximately $\frac{1}{3}$ of the vertical tubes 33, there is preferably a horizontal rectangular frame 31, which preferably has dimensions of about $6\times3$ m, and preferably has a transverse strut 51, preferably about 3 m long, in the center.

Essentially, a very stable frame is created in this manner, one which is particularly well suited for vertical stacking, inside which essentially any desired components can be installed.

The rectangular frame 31 and the crossarm 51 thus preferably divide the standard container frame 17 into a lower part 29 and an upper part 30. The upper part 30 is preferably approximately 2 m high, i.e. it is preferably man-sized, or large enough for access by people. The lower part 29 is preferably primarily used for the installation of lines, equipment, etc.

Figure 25:
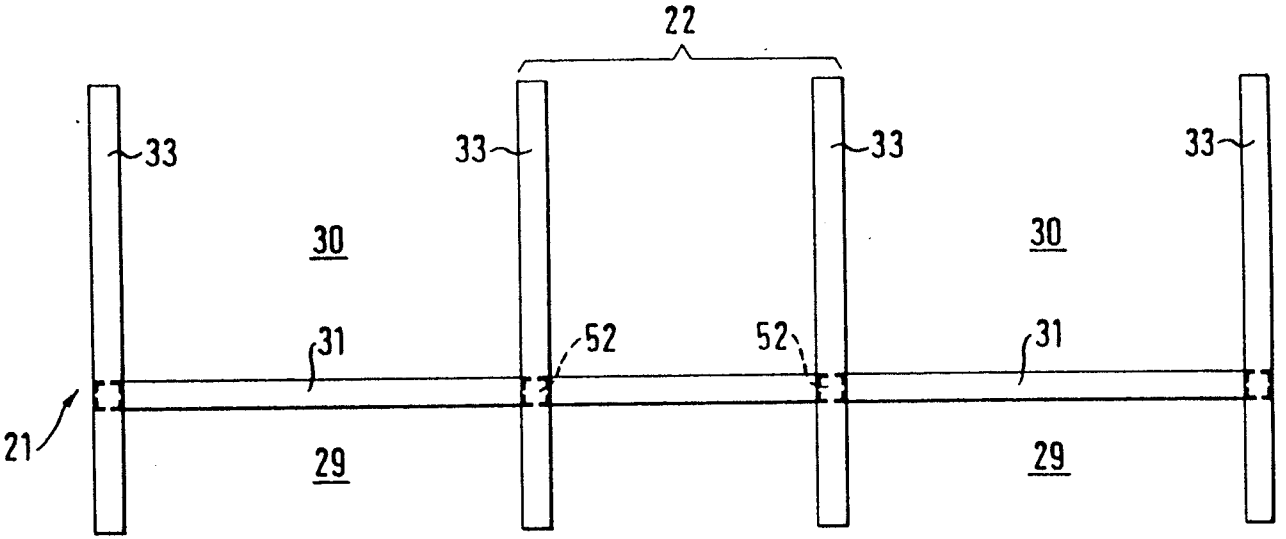
FIG. 25: A side view, similar to FIG. 22, of an adjustable container frame according to the invention.
Figure 26:
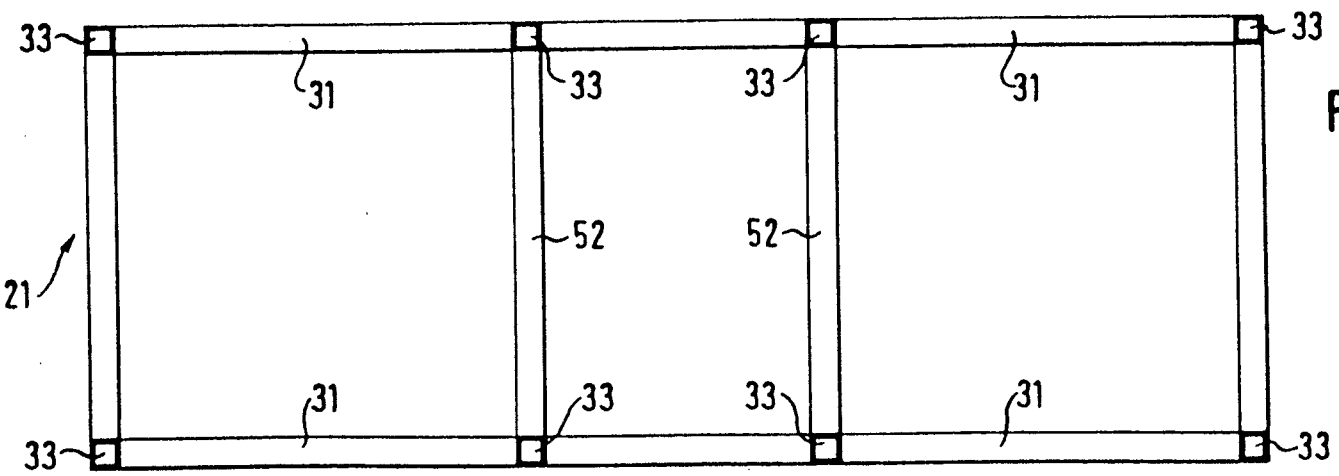
FIG. 26: A plan view of the subject of FIG. 25.

FIGS. 25 and 26 show views which are similar to FIGS. 22 and 23, but also show an adjustable container 21, the central adjustable part 22 of which, in contrast to the embodiment illustrated in FIGS. 1 to 19, is preferably narrower than the lateral regions, which preferably have the modular dimension. The standard container frame 17 illustrated in FIG. 26 is also preferably equipped with two crossarms 52 separated by the length of the adjustable area 22.

In the embodiment illustrated in FIGS. 25 and 26, the height of the rectangular tubes 33 is also preferably about 3 m.

Figure 27:
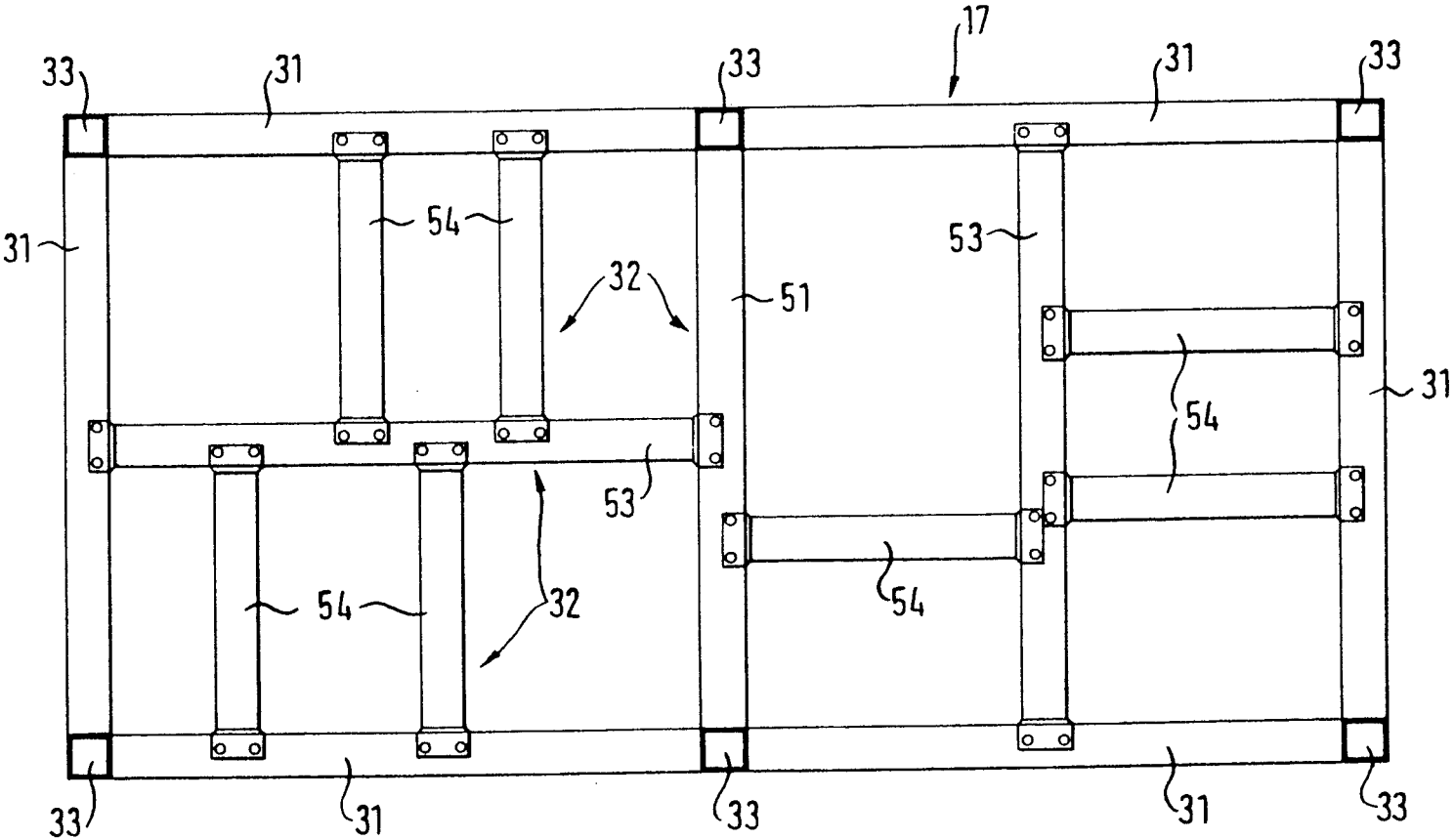
FIG. 27: A plan view as in FIG. 21, also including a substructure.
Figure 27A:
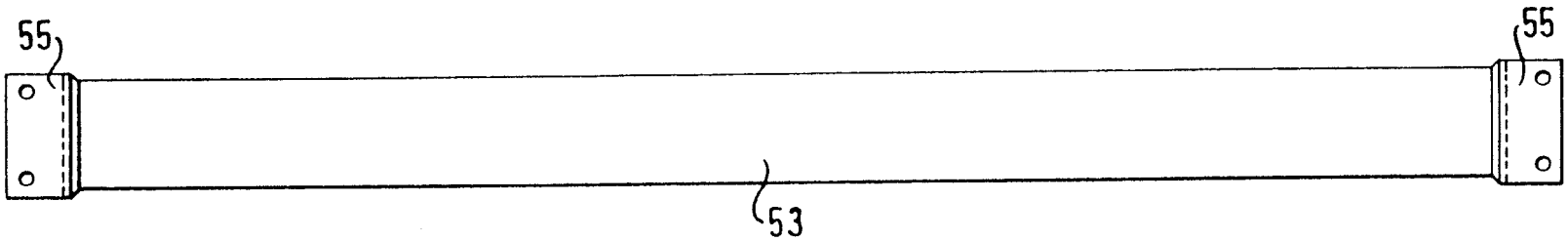
FIG. 27*a*: A plan view of a long strut 53 of the substructure illustrated in FIG. 27.
Figure 27C:
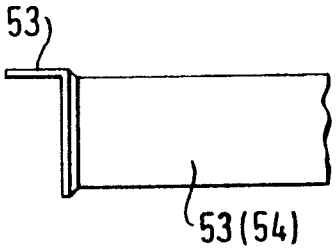
FIG. 27*c*: A partial side view of the ends of the struts 53, 54 illustrated in FIGS. 27*a* and 27*b*.
Figure 27B:
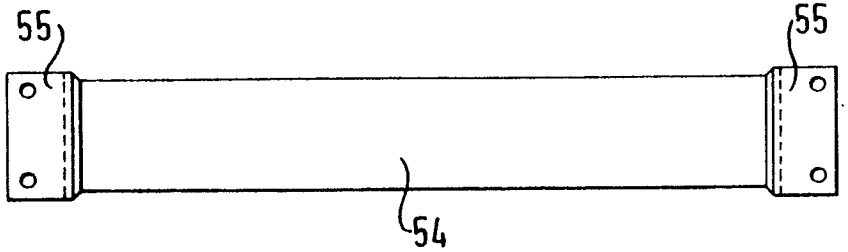
FIG. 27*b*: A plan view of a short strut 54 of the substructure illustrated in FIG. 27.

FIG. 27 shows a view of a standard container frame 17, similar to the one illustrated in FIG. 23, but where, according to the invention, a substructure 32 is preferably installed at the level of the rectangular frame 31 and of the crossarm 51. The substructure preferably consists of struts 53 in the modular size of approximately 3 m, and struts 54 in half-modular size of approximately 1.50 m which, as shown in FIGS. 27*a*, 27*b* and 27*c*, are preferably designed as rectangular tubes with angle ends 55, which are placed on the surface of the rectangular frame 31, the crossarm 51 or the long struts 53, and are fastened there, e.g. by means of Peco bolts, or other appropriate means.

Figure 28:
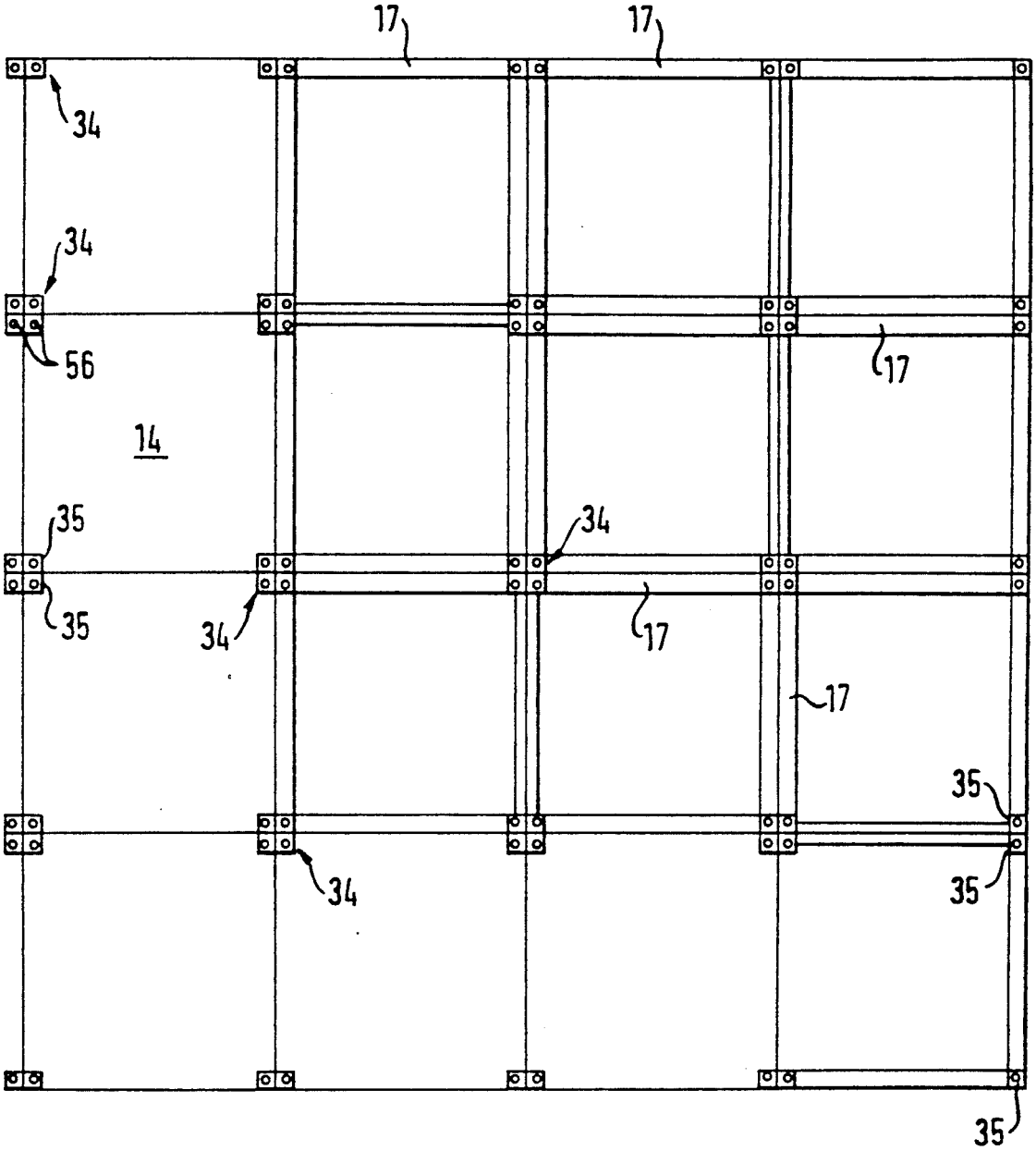
FIG. 28: The plan view of an arrangement of four containers with rectangular base surface on standard pipes, which are located on a horizontal stepped wall of the ship's hull.
Figure 29:
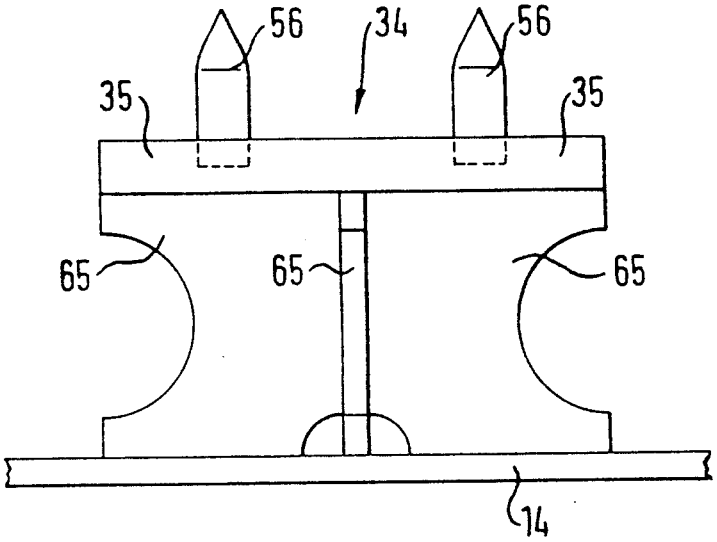
FIG. 29: A side view of a modular support according to the invention.
Figure 30:
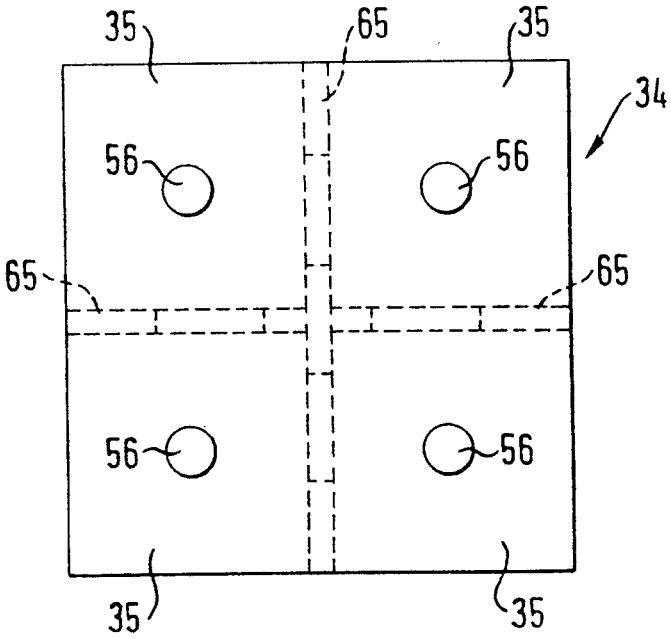
FIG. 30: A plan view of a modular support according to the invention, with four connecting elements.
Figure 31:
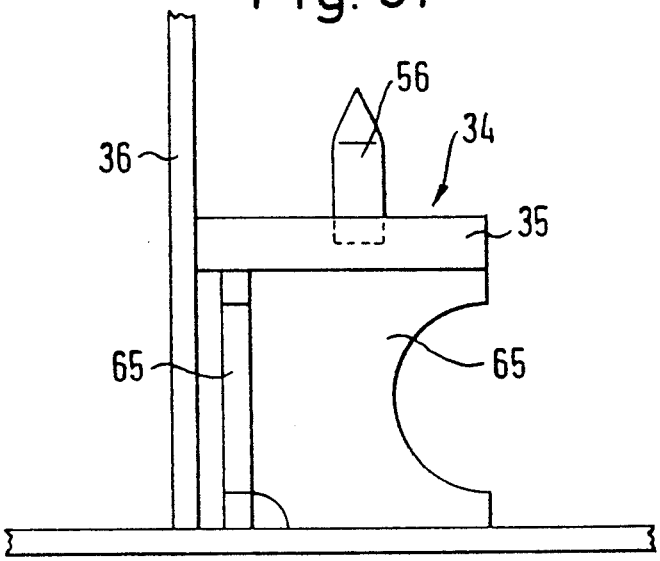
FIG. 31: A side view of a modular support according to the invention with only two connecting elements.
Figure 32:
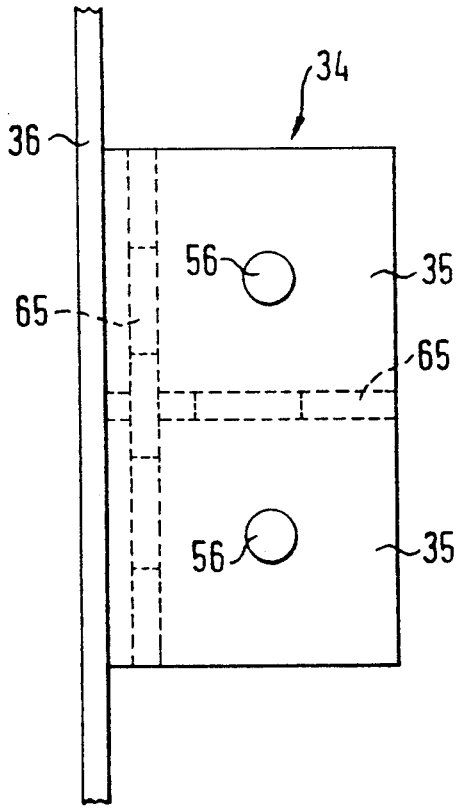
FIG. 32: A plan view of the subject of FIG. 31.

The plan view in FIG. 28 shows an example of the arrangement of a number of modular supports 34 on a horizontal stepped wall 14. As shown in FIGS. 29 and 30, each modular support preferably consists of a cruciform base 65, on which a square plate is located, which has a total of four plate-shaped connection elements 35 oriented parallel to the floor, or horizontal stepped wall, 14, each of which preferably has an alignment pin 56 projecting vertically upward in the center.

Figure 33:
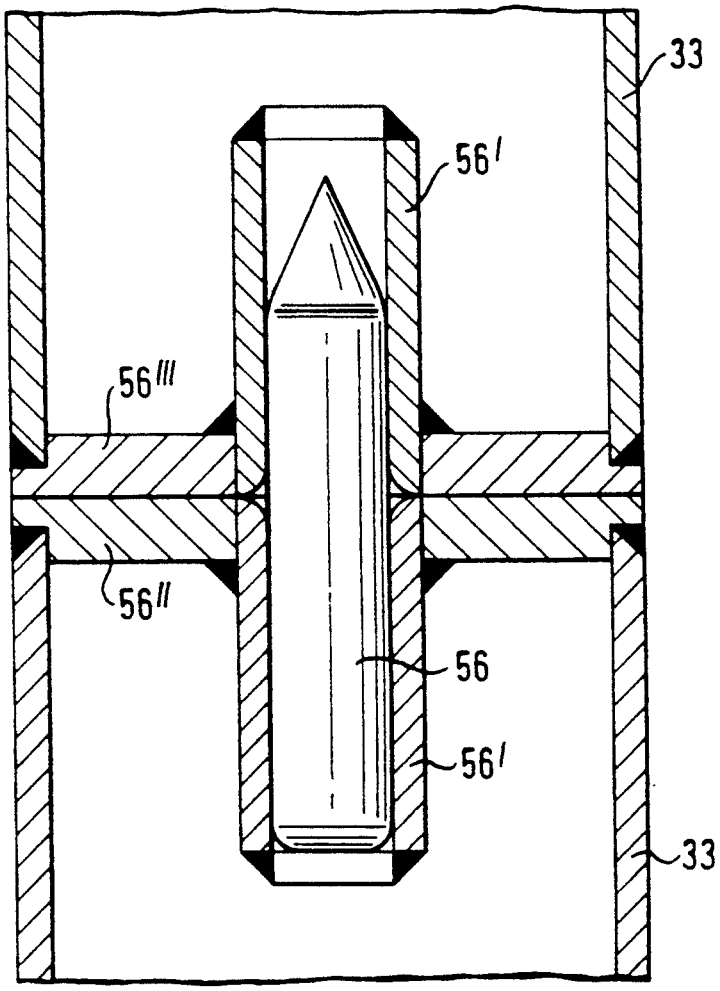
FIG. 33: A vertical section through the plug-in connection of two rectangular tubes for containers located on top of one another.

The rectangular tubes 33 are preferably configured on their underside like the upper rectangular tube 33 in FIG. 33, so that they are essentially pushed with a bottom vertical alignment hole 56' in a lower end plate 56'' in the alignment seat on the vertical alignment pin 56, and thus are essentially perfectly adjusted relative to the stepped wall 14.

As shown in FIG. 28, a total of five rectangular standard containers may be located in close contact with one another on the modular supports 34 arranged in accordance with the modular dimension.

In the vicinity of a bunker wall 36, the base 65 of a modular support 34 can also preferably consist of only two connecting elements 35 next to one another, with two alignment pins 56 located on the corners of a modular dimension. One connecting element 35 essentially suffices in the corners.

Just as the rectangular tubes 33 can be placed over the alignment pins 56 of the base 55 by means of their vertical alignment holes 56', two rectangular tubes 33, as shown in FIG. 33, can also be connected in the axial orientation, by locating an alignment pin 56 in their same-sized alignment holes 56'. The alignment pin 56 is first hammered into the alignment hole 56' of the upper end plate 56'', and then the end plate 56''' with the alignment hole 56' is placed over the pin from above.

Figure 36:
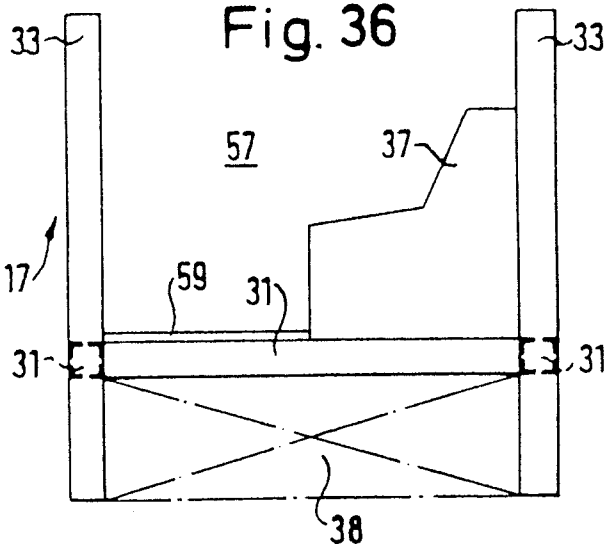
FIG. 36: An end view of the subject of FIG. 34.
Figure 34:
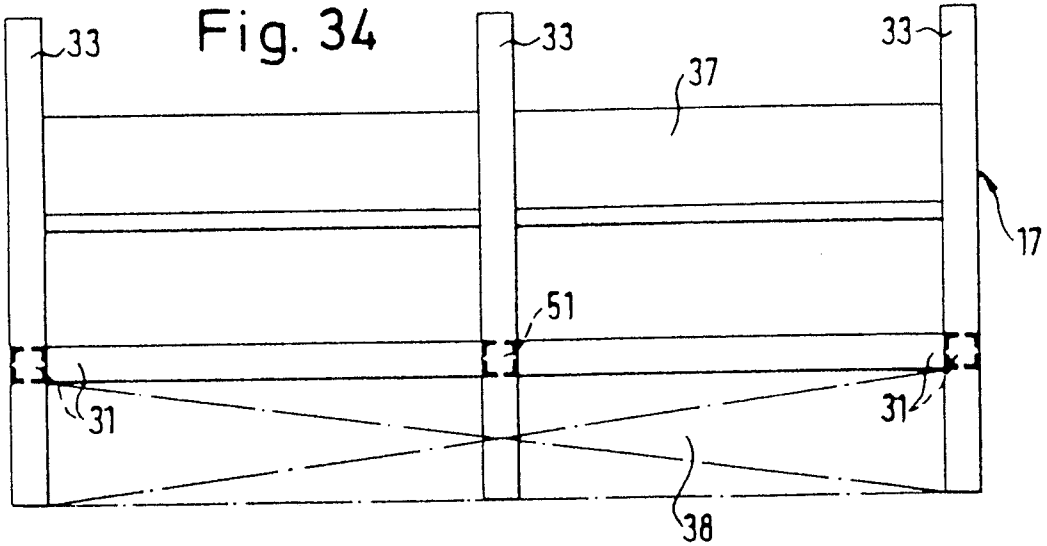
FIG. 34: A side view of a container according to the invention, similar to FIG. 22, whereby the installation of a control stand and a space for lines is indicated.
Figure 35:
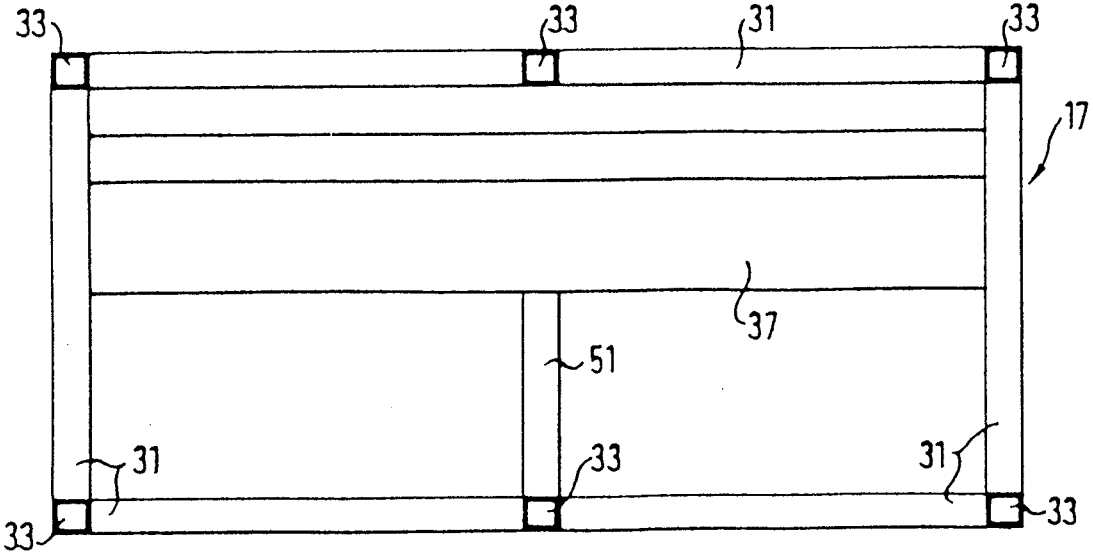
FIG. 35: A plan view of the subject of FIG. 34.

As shown in FIGS. 34 to 36, a control stand 37 is preferably located in a standard container 17 above the rectangular frame 31. The space 57 available in front of the control stand 37 is preferably configured to be easily large enough for access by a person. The space in front of the control stand 37 can, for example, preferably be formed by a panel 59 laid as a floor. There is preferably a space 38 for lines, etc. below the rectangular frame 31.

Figure 39:
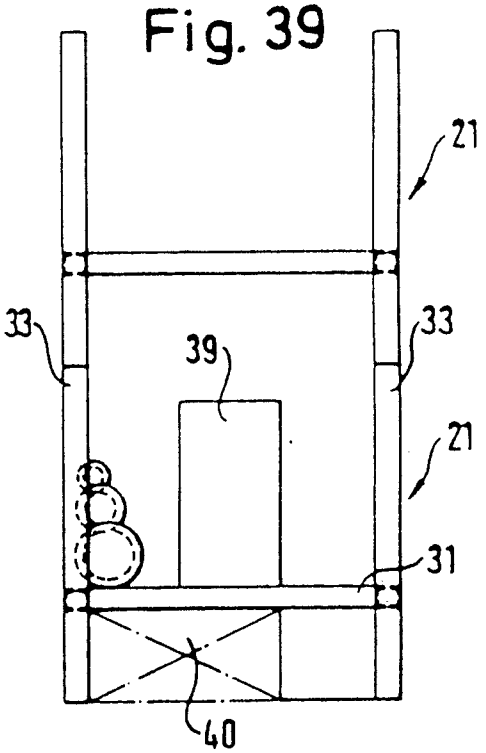
FIG. 39: An end view of the subject of FIG. 37, whereby an additional adjustable container is located on the lower adjustable container.
Figure 37:
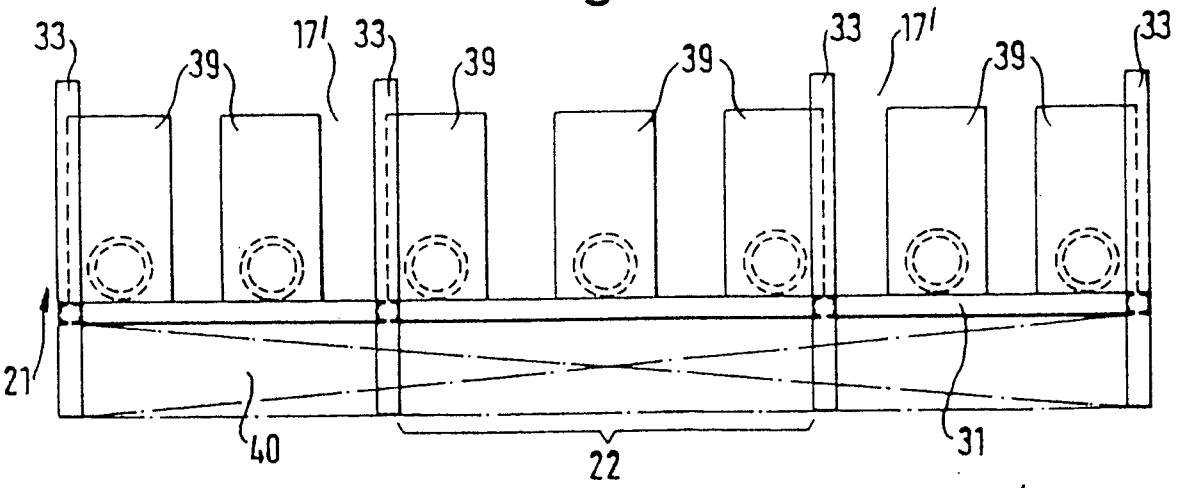
FIG. 37: A side view of an adjustable container with an expanded adjustment section, which shows schematically the installation of seawater pumps and a seawater conduit.
Figure 38:
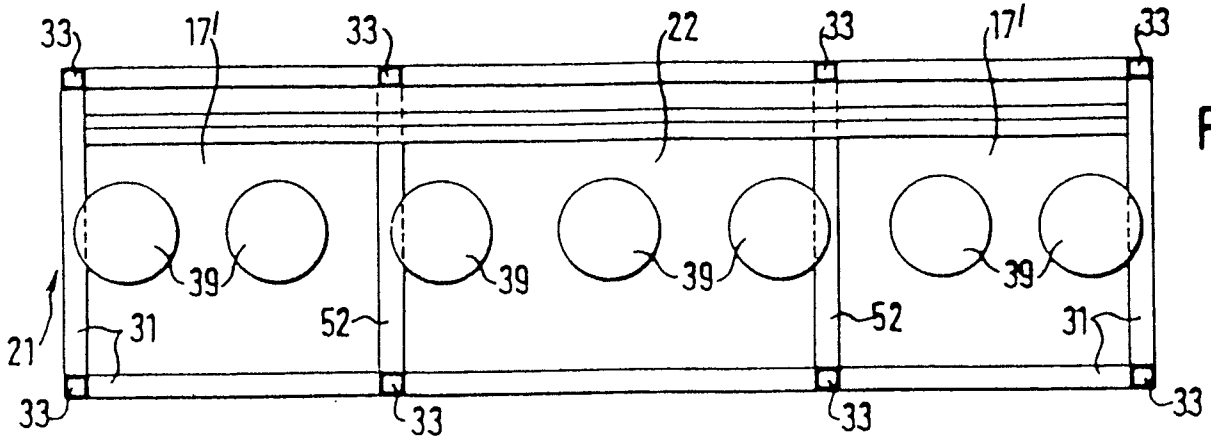
FIG. 38: A plan view of the subject of FIG. 37.

FIGS. 37 to 39 show an adjustable container 21 with a central adjustment section 22, and two lateral cubic sections 17', which are in the modular dimension. In the upper portion, seawater pumps 39 are preferably located one behind the other, while there are lines and, among other things, a sea water conduit 40 below the rectangular frame 31.

FIG. 39 shows the stacking of two adjustable container frames 21 on top of one another, in accordance with the invention.

Figure 40:
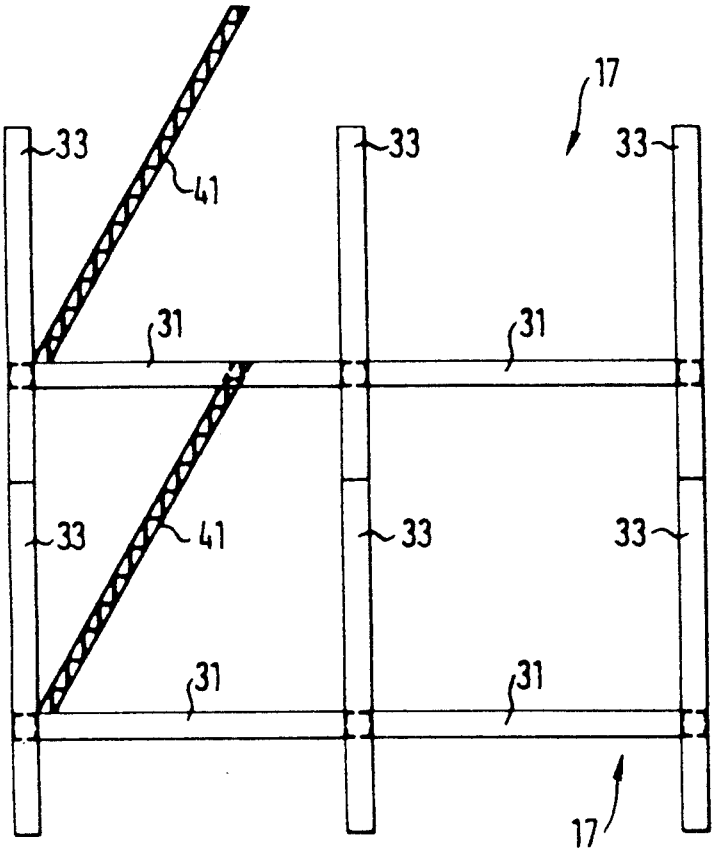
FIG. 40: A side view of two standard containers, one on top of the other, whereby the installation of steps is also indicated.
Figure 42:
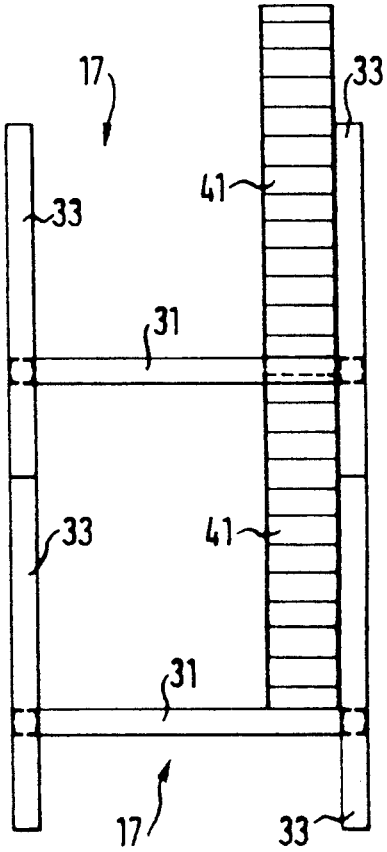
FIG. 42: An end view of the subject of FIG. 40.
Figure 41:
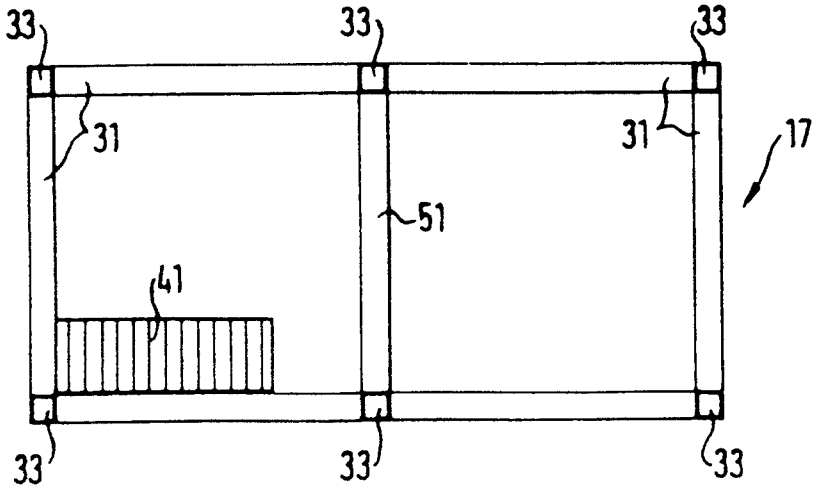
FIG. 41: A plan view of the subject of FIG. 40.

Finally, FIGS. 40 to 42 show the arrangement of stairs 41 between two standard container frames 17 stacked one on top of the other. In this manner, the various levels of the containers located above one another can be easily accessible for people.

One feature of the invention resides broadly in a ship, in particular merchant ship, with at least one large power plant such as a main propulsion engine 11 located in the ship's steel hull, around which there are the necessary auxiliary spaces, such as access spaces, bunkers, tanks, compartments, control rooms, workshops, control devices, distribution centers, pumps, hydraulic power plants, etc., characterized by the fact that the ship's hull 12, in the vicinity of the main power plant 11, has a nacelle 20 which is open on top, which is designed so that it becomes wider in steps from bottom to top and/or in the longitudinal direction of the ship 13, and is preferably free of bulkheads and platforms, that the height, length and width of the stepped walls 14, 15, 16 next to or under the main power plant 11 are of a specified modular dimension on the order of several meters, in particular 3 m, in at least one dimension, in particular the height, but preferably in two dimensions, and particularly preferably in all three dimensions, and at least a significant portion of the auxiliary spaces are located in rectangular containers or container frames 17, 21, 25 located next to, forward and/or aft of the main power plant 11 or on the stepped walls 14, 15, 16.

Another feature of the invention resides broadly in the ship, characterized by the fact that between the stepped walls 14, 15, 16 and the external skin 19 of the ship, there are usable spaces 18 such as bunkers, tanks, compartments, workshops, etc.

Yet another feature of the invention resides broadly in the ship, in which the main power plant is the main propulsion engine, characterized by the fact that the nacelle 20 is in the stern area of the ship, and is tapered in steps on the modular dimension from fore to aft.

Still another feature of the invention resides broadly in the ship, characterized by the fact that the space between the external skin 19 and the nacelle 2, in which the usable spaces are located has, at least for the most part, dimensions which are less than the modular dimension.

Another feature of the invention resides broadly in the ship, characterized by the fact that forward and/or aft of the main power plant 11, there are adjustable containers or adjustable container frames 21, 25, which are the size of the modular dimension in at least one and preferably two dimensions, one of which should be the height, and which have a section 22, 26 which is not in the modular dimension, in the transverse direction of the ship and/or in the longitudinal direction of the ship, which corresponds in particular to the width of the main power plant 11 or to the length of the shaft 27.

Yet another feature of the invention resides broadly in the ship, characterized by the fact that the containers or container frames 17, 21, 25 have a uniform height which corresponds to the modular dimension, e.g. 3 m.

Still yet another feature of the invention resides broadly in the ship, characterized by the fact that there are standard containers 17 or standard container frames with a rectangular base surface, whereby the short side 23 corresponds to the modular dimension, e.g. 3 m, and the long side 24 is twice the modular dimension, e.g. 6 m.

Another feature of the invention resides broadly in the ship, characterized by the fact that in the stepped walls 14, 15, 16 there are apertures 28 at standardized points, which preferably have the size of a manhole.

Yet another feature of the invention resides broadly in the ship, characterized by the fact that the containers or container frames 17, 21, 25 are divided in the vertical direction into a lower part 29 occupying approximately $\frac{1}{3}$ of the modular dimension, and an upper part 30 occupying approximately $\frac{2}{3}$ of the modular dimension.

Still another feature of the invention resides broadly in the ship, characterized by the fact that between the lower and upper parts 29, 30 of the container or container frame 17, 21, 25 there is a rectangular frame 31 which determines the outside dimensions, on which a substructure 32 can be placed to hold equipment or to allow access by persons.

Another feature of the invention resides broadly in the ship, characterized by the fact that the containers or container frames 17, 21, 25 have support tubes, in particular rectangular tubes 33 in the modular dimension.

Still another feature of the invention resides broadly in the ship, characterized by the fact that vertical tubes 33 are located at the modular dimension or at the limits of the adjustable areas 22, 26 along the circumference, and are preferably held together only by a rectangular frame 32, 51, 52.

Still yet another feature of the invention resides broadly in the ship, characterized by the fact that the containers or container frames 17, 21, 25 can be connected to one another or to the horizontal stepped walls 14 by plug-in connections, in a perfectly vertically oriented manner.

Several U.S. Patents describe bulkheads, ribs, gussets, other arrangements for reinforcing the hull or other wall structures of a ship, and other components which may be utilized, as set forth heretofore, in accordance with the embodiments of the present invention. These U.S. Patents include: U.S. Pat. No. 4,630,561, which issued to Franz et al. on Dec. 23, 1986; U.S. Pat. No. 4,658,747, which issued to Franz et al. on Apr. 21, 1987; U.S. Pat. No. 4,678,439, which issued to Schlichthorst on Jul. 7, 1987; and U.S. Pat. No. 4,711,193 to Latza et al., which issued on Dec. 8, 1987.

All, or substantially all, of the components and methods of the various embodiments may be used in any combination with at least one embodiment or all of the embodiments, if any, described herein.

All of the patents, patent applications and publications recited herein and in the attached declaration, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. Method for building and outfitting a ship, the ship having a longitudinal direction, a vertical direction and a transverse direction perpendicular to both the vertical direction and the longitudinal direction, said method comprising:

providing a hull, the hull having at least one width defined in the transverse direction of the ship;

configuring the hull to have a varying width;

providing a main power plant and disposing the main power plant within the hull;

providing, within the hull, a nacelle compartment;

configuring the nacelle compartment to be open at an upper portion of the ship;

configuring the nacelle compartment to have a varying width which varies as a function of at least one of:

the vertical direction of the ship; and the longitudinal direction of the ship;

configuring the width of the nacelle compartment to increase, stepwise, from a lower portion of the ship to an upper portion of the ship;

configuring the width of the nacelle compartment to vary generally in proportion to the varying width of the ship;

configuring the nacelle compartment to comprise stepped walls, the stepped walls defining the stepwise increase of the width of the nacelle compartment from the lower portion of the ship to the upper portion of the ship;

configuring the stepped walls of the nacelle compartment to have a single predetermined modular dimension, in each of at least two orthogonally distinct directions, in the vicinity of the main power plant;

disposing, within the hull, a plurality of containers in at least one of the following positions;

transversely adjacent the main power plant;

forwardly of the main power plant;

rearwardly of the main power plant; and on at least one of the stepped walls;

configuring each of the containers to comprise auxiliary space; and outfitting the ship by outfitting the auxiliary spaces provided by the containers.

2. The method according to claim 1, further comprising the step of:

configuring the stepped walls of the nacelle compartment to have a single predetermined dimension, in each of three orthogonally distinct directions, in the vicinity of the main power plant.

3. The method according to claim 2, further comprising the step of:

prior to said step of disposing the containers within the hull, configuring the nacelle compartment such that the nacelle compartment is free of bulkheads and platforms.

4. The method according to claim 3, further comprising the steps of:

providing an outer wall for the hull;

configuring the ship such that, between the stepped walls of the nacelle compartment and the outer wall of the hull, there is usable space.

5. The method according to claim 4, wherein the ship has a stern, said method further comprising the step of:

configuring the ship such that:

the ship has a main engine;

the main power plant comprises the main engine; and the nacelle compartment is disposed towards the stern of the ship.

6. The method according to claim 5, further comprising the steps of:

configuring the width of the nacelle compartment to vary stepwise along the longitudinal direction of the ship and to decrease from a forward portion of the nacelle compartment towards the stern of the ship;

configuring the usable space, between the stepped walls of the nacelle compartment and the outer wall of the hull, such that:

the usable space has a width dimension, defined between the stepped walls of the nacelle compartment and the outer wall of the ship; and the width dimension of the usable space is generally less than the modular dimension;

configuring at least some of the containers to comprise adjustable container means; configuring the adjustable container means such that:

each of the adjustable container means has first, second and third linear dimensions; and at least one of the first, second and third linear dimensions is approximately equivalent to the modular dimension;

one of the first, second and third linear dimensions is a height dimension defined in the vertical direction of the ship;

two of the first, second an third linear dimensions, including the height dimension, are equivalent to the modular dimension; and the remaining one of the first, second and third linear dimensions is different from the modular dimension; and configuring the ship such that:

each of the containers has a height dimension, defined in the vertical direction of the ship, being approximately equivalent to the modular dimension;

the modular dimension is about 3 meters;

the containers comprise standard containers, each of the standard containers having a first linear dimension, in the longitudinal direction of the ship, equivalent to the modular dimension and a second linear dimension, in the transverse direction of the ship, equivalent to twice the modular dimension;

the stepped walls comprise a plurality of apertures disposed therewithin, each of the plurality of apertures having a diameter approximately equivalent to that of a manhole;

each of the containers is divided, in the vertical direction of the ship, into a lower part and an upper part, the lower part comprising approximately $\frac{1}{3}$ of the modular dimension and the upper part comprising approximately $\frac{2}{3}$ or the modular dimension each of the containers comprises an intermediate frame, the intermediate frame being rectangular and being configured to establish the linear dimensions of the container;

each of the intermediate frames being configured to accommodate thereon a substructure for permitting at least one of:

access by individuals; and holding of equipment;

each of the containers comprises a plurality of vertically extending support tubes;

each of the support tubes having a vertical dimension corresponding to the vertical dimension of the container;

the support tubes are held together by the intermediate frame of the container;

means are provided for connecting containers with one another for connecting containers with the stepped walls of the nacelle compartment;

the connecting means comprise plug-in connections;

the connecting means comprise means for aligning different containers vertically with respect to one another;

three adjustable container means, stacked on top of one another, are for being disposed forward of the main engine;

a fourth adjustable container means is for being disposed astern of the main engine;

the ship comprises a shaft, the shaft has a length, parallel to the longitudinal direction of the ship, within the ship;

the shaft extends from the main engine;

the main engine has a width, defined in the transverse direction of the ship;

each of the three stacked adjustable container means and the fourth adjustable container means have:

a width approximately equivalent to the width of the main engine; and a height equivalent to the modular dimension;

the fourth adjustable container means has a length, defined in the longitudinal direction of the ship, approximately equal to the length of the shaft within the ship;

a fifth adjustable container means is for being positioned above the fourth adjustable container means;

the fifth adjustable container means has:

a length, defined in the longitudinal direction of the ship, approximately equivalent to the length of the shaft within the ship;

a width, defined in the transverse direction of the ship, approximately equivalent to the width of the main engine plus twice the modular dimension; and a height approximately equivalent to the modular dimension;

the apertures are configured for providing access between the nacelle compartment and the usable space between the central compartment and the outer wall of the hull;

the vertical support tubes each have a generally rectilinear cross-section with dimensions of about 0.2 meter by about 0.2 meter;

the ship comprises a floor, a lower platform deck disposed above the floor, an upper platform deck disposed above the lower platform deck, and a main deck disposed above the upper platform deck;

each of the following distances being approximately equal to the modular dimension;

between the floor and the lower platform deck;

between the lower platform deck and the upper platform deck; and between the upper platform deck and the main deck; the space within the nacelle compartment and:

transversely adjacent the main engine;

forwardly of the main engine; and astern the main engine;

being substantially completely filled by containers;

the ship includes means for reinforcing the stepped walls, the reinforcing means being disposed within the space between the stepped walls and the outer wall of the hull;

the nacelle compartment is delineated by a bulkhead at a forward portion thereof;

the ship comprises supply shaft means being disposed forward of the nacelle compartment bulkhead;

each of the containers comprises a transverse strut.

7. A ship comprising:

a longitudinal direction, a vertical direction and a transverse direction perpendicular to both the vertical direction and the longitudinal direction;

a hull, said hull having a varying width defined in the transverse direction of said ship;

a main power plant being disposed within said hull;

a nacelle compartment being disposed within said hull;

said nacelle compartment being open at an upper portion of said ship;

said nacelle compartment having a varying width which varies as a function of at least one of:

the vertical direction of said ship; and the longitudinal direction of said ship;

the width of said nacelle compartment increasing, stepwise, from a lower portion of said ship to an upper portion of said ship;

the width of said nacelle compartment varying generally in proportion to the varying width of said ship;

said nacelle compartment comprising stepped walls, said stepped walls defining the stepwise increase of the width of said nacelle compartment from said lower portion of said ship to said upper portion of said ship;

said stepped walls of said nacelle compartment having a single predetermined modular dimension, in each of at least two orthogonally distinct directions, in the vicinity of said main power plant;

a plurality of containers being disposed in said hull in at least one of the following positions;

transversely adjacent said main power plant;

forwardly of said main power plant;

rearwardly of said main power plant; and on at least one of said stepped walls;

each of said containers comprising auxiliary space; and said auxiliary spaces provided by said containers being outfitted.

8. The ship according to claim 7, wherein said stepped walls of said nacelle compartment have a single predetermined dimension, in each of three orthogonally distinct directions, in the vicinity of said main power plant.

9. The ship according to claim 8, wherein said nacelle compartment is free of bulkheads and platforms.

10. The ship according to claim 9, wherein:

said hull comprises an outer wall; and said stepped walls of said nacelle compartment and said outer wall of said hull define usable space therebetween.

11. The ship according to claim 10, further comprising:

a stern;

a main engine;

said main power plant comprising said main engine; and said nacelle compartment being disposed towards said stern of said ship.

12. The ship according to claim 11, wherein:

the width of the nacelle compartment varies stepwise along the longitudinal direction of said ship and decreases from a forward portion of said nacelle compartment towards said stern of said ship;

said usable space, between said stepped walls of said nacelle compartment and said outer wall of said hull has a width dimension, defined between said stepped walls of said nacelle compartment and said outer wall of said ship;

the width dimension of said usable space is generally less than the modular dimension;

at least some of said containers comprise adjustable container means;

each of said adjustable container means has first, second and third linear dimensions;

at least one of the first, second and third linear dimensions is approximately equivalent to the modular dimension;

one of the first, second and third linear dimensions is a height dimension defined in the vertical direction of said ship;

two of the first, second and third linear dimensions, including the height dimension, are equivalent to the modular dimension;

the remaining one of the first, second and third linear dimensions is different from the modular dimension;

each of said containers has a height dimension, defined in the vertical direction of said ship, being approximately equivalent to the modular dimension;

the modular dimension is about 3 meters;

said containers comprise standard containers, each of said standard containers having a first linear dimension, in the longitudinal direction of said ship, equivalent to the modular dimension and a second linear dimension, in the transverse direction of said ship, equivalent to twice the modular dimension;

said stepped walls comprise a plurality of apertures disposed therewithin, each of said plurality of apertures having a diameter approximately equivalent to that of a manhole;

each of said containers is divided, in the vertical direction of said ship, into a lower part and an upper part, said lower part comprising approximately $\frac{1}{3}$ of the modular dimension and said upper part comprising approximately $\frac{2}{3}$ of the modular dimension;

each of said containers comprises an intermediate frame, said intermediate frame being rectangular and being configured to establish the linear dimensions of said container;

each of said intermediate frames being configured to accommodate thereon a substructure for permitting at least one of:

access by individuals; and holding of equipment;

each of said containers comprises a plurality of vertically extending support tubes;

each of said support tubes has a vertical dimension corresponding to the vertical dimension of said container;

said support tubes are held together by said intermediate frame of said container;

said ship comprises means for connecting containers with one another for connecting containers with said stepped walls of said nacelle compartment;

said connecting means comprise plug-in connections;

said connecting means comprise means for aligning different containers vertically with respect to one another;

three adjustable container means, stacked on top of one another, being disposed forward of said main engine;

a fourth adjustable container means being disposed astern of said main engine;

said ship comprises a shaft, said shaft has a length, parallel to the longitudinal direction of said ship, within said ship;

said shaft extends from said main engine;

said main engine has a width, defined in the transverse direction of said ship;

each of said three stacked adjustable container means and said fourth adjustable container means have:

a width approximately equivalent to the width of said main engine; and a height equivalent to the modular dimension;

said fourth adjustable container means has a length, defined in the longitudinal direction of said ship, approximately equal to the length of said shaft within said ship;

a fifth adjustable container means is positioned above said fourth adjustable container means;

said fifth adjustable container means has:

a length, defined in the longitudinal direction of said ship, approximately equivalent to the length of said shaft within said ship;

a width, defined in the transverse direction of said ship, approximately equivalent to the width of said main engine plus twice the modular dimension; and a height approximately equivalent to the modular dimension;

said apertures are configured for providing access between said nacelle compartment and said usable space between said nacelle compartment and said outer wall of said hull;

said vertical support tubes each have a generally rectilinear cross-section with dimensions of about 0.2 meter by about 0.2 meter;

said ship comprises a floor, a lower platform deck disposed above said floor, an upper platform deck disposed above said lower platform deck, and a main deck disposed above said upper platform deck;

each of the following distances is approximately equal to the modular dimension;

between said floor and said lower platform deck;

between said lower platform deck and said upper platform deck; and between said upper platform deck and said main deck;

said space within said nacelle compartment and:

transversely adjacent said main engine;

forwardly of said main engine; and astern said main engine;

is substantially completely filled by containers;

said ship includes means for reinforcing said stepped walls, said reinforcing means being disposed within said space between said stepped walls and said outer wall of said hull;

said nacelle compartment is delineated by a bulkhead at a forward portion of said nacelle compartment;

said ship comprises supply shaft means being disposed forward of said nacelle compartment bulkhead;

each of said containers comprises a transverse strut.

* * * * *